US008807558B2

(12) United States Patent
Nguyen et al.

(10) Patent No.: US 8,807,558 B2
(45) Date of Patent: Aug. 19, 2014

(54) SHEET CONVEYING DEVICE

(71) Applicants: Minh Duc Nguyen, Nagoya (JP); Tomoya Yamamoto, Nagoya (JP)

(72) Inventors: Minh Duc Nguyen, Nagoya (JP); Tomoya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/799,715

(22) Filed: Mar. 13, 2013

(65) Prior Publication Data

US 2013/0256970 A1 Oct. 3, 2013

(30) Foreign Application Priority Data

Mar. 30, 2012 (JP) ..... 2012-078478
Oct. 22, 2012 (JP) ..... 2012-232969

(51) Int. Cl.

| | |
|---|---|
| ***B65H 31/00*** | (2006.01) |
| ***B65H 5/00*** | (2006.01) |
| ***B65H 5/06*** | (2006.01) |
| ***G03G 21/16*** | (2006.01) |
| ***B65H 29/14*** | (2006.01) |
| *G03G 15/00* | (2006.01) |

(52) U.S. Cl.

CPC ..... *B65H 5/00* (2013.01); *B65H 2403/722* (2013.01); *B65H 5/062* (2013.01); *B65H 2402/441* (2013.01); *B65H 2404/144* (2013.01); *B65H 2402/46* (2013.01); *B65H 2801/06* (2013.01); *G03G 21/1695* (2013.01); *B65H 29/14* (2013.01); *B65H 2404/143* (2013.01); *G03G 15/6573* (2013.01); *G03G 21/1633* (2013.01); *B65H 2403/53* (2013.01)

USPC ..... 271/207; 271/278; 399/124

(58) Field of Classification Search

USPC ..... 271/278, 207, 273; 399/124, 21

See application file for complete search history.

(56) References Cited

U.S. PATENT DOCUMENTS

| | | | | |
|---|---|---|---|---|
| 6,253,046 | B1 * | 6/2001 | Horrall et al. | 399/124 |
| 6,621,997 | B2 * | 9/2003 | Chung | 399/122 |
| 6,643,480 | B2 * | 11/2003 | Kuwata et al. | 399/107 |
| 6,950,619 | B2 * | 9/2005 | Sunohara | 399/124 |
| 7,330,682 | B2 * | 2/2008 | Shinshi | 399/122 |
| 7,364,149 | B2 * | 4/2008 | Terao et al. | 270/58.13 |
| 7,460,813 | B2 * | 12/2008 | Kuwata et al. | 399/110 |
| 7,515,850 | B2 * | 4/2009 | Hasegawa | 399/124 |
| 7,831,173 | B2 * | 11/2010 | Kusukawa et al. | 399/114 |

(Continued)

FOREIGN PATENT DOCUMENTS

JP 2010-052889 A 3/2010

*Primary Examiner* — Kaitlin Joerger
(74) *Attorney, Agent, or Firm* — Banner & Witcoff, Ltd.

(57) ABSTRACT

A sheet conveying device includes: a main body; a cover; a first roller; and a second roller. The main body defines a conveying passage along which a sheet is conveyed. The cover is supported to the main body and movable between a closed position in which the cover covers the main body from above and an open position in which the cover is moved upward from the main body so as to be spaced away from the main body. The first roller is rotatably supported to the cover and configured to discharge the sheet from the conveying passage to an outside of the main body. The second roller is rotatably supported to the main body and disposed in confrontation with the first roller while interposing the conveying passage between the first roller and the second roller when the cover is at the closed position.

20 Claims, 14 Drawing Sheets

(56) References Cited

U.S. PATENT DOCUMENTS

| | | | | |
|---|---|---|---|---|
| 7,957,674 | B2 | 6/2011 | Yamaguchi | |
| 7,979,000 | B2 * | 7/2011 | Sekina et al. | 399/121 |
| 2004/0190940 | A1 * | 9/2004 | Sasoh et al. | 399/124 |
| 2006/0216060 | A1 * | 9/2006 | Kuwata et al. | 399/110 |
| 2006/0239715 | A1 * | 10/2006 | Lee et al. | 399/122 |
| 2010/0054808 | A1 | 3/2010 | Yamaguchi | |
| 2010/0150636 | A1 * | 6/2010 | Kubota et al. | 399/407 |
| 2010/0237556 | A1 * | 9/2010 | Azuma et al. | 271/207 |

* cited by examiner

SHEET CONVEYING DEVICE

CROSS REFERENCE TO RELATED APPLICATION

This application claims priority from Japanese Patent Applications No. 2012-078478 filed Mar. 30, 2012 and No. 2012-232969 filed Oct. 22, 2012. The entire content of each of these priority applications is incorporated herein by reference.

TECHNICAL FIELD

The present invention relates to a sheet conveying device.

BACKGROUND

A conventional sheet conveying device includes a main body, a cover, a first roller, and a second roller. The cover is supported to the main body and movable relative to the main body between a closed position where the cover covers the main body from above and an open position where the cover is spaced away from and upward of the main body. The first and second rollers are rotatably supported to the cover. The first roller is adapted to discharge a sheet to an outside of the main body from a sheet conveying passage in which the sheet is conveyed. The second roller is in confrontation with the first roller, interposing the sheet conveying passage with the first roller, in a state where the cover is at the closed position. Further, the second roller is configured to be driven to rotate by the first roller.

This sheet conveying device further includes a drive source and a drive force transmission unit. The drive force transmission unit is adapted to transmit a drive force from the drive source to the first roller. The drive force transmission unit includes a main body side transmission unit provided at the main body and a cover side transmission unit provided at the cover. In the state where the cover is at the closed position, the main body side transmission unit and the cover side transmission unit are connected to each other, thereby transmitting the drive force from the drive source to the first roller through the main body side transmission unit and the cover side transmission unit. Further, in a state where the cover is at the open position, the main body side transmission unit and the cover side transmission unit are spaced away from each other, thereby interrupting transmission of the drive force from the drive source to the first roller.

The main body side transmission unit further includes a connecting portion. In the state where the cover is at the closed position, the connecting portion is connected to the cover side transmission unit. On the other hand, in the state where the cover is at the open position, the connecting portion is spaced away from the cover side transmission unit and exposed to an outside of the main body.

In this sheet conveying device, when the cover is moved to the open position while a sheet jam has occurred in the sheet conveying passage at a position adjacent to the first roller and the second roller, the first and second rollers are moved integrally with the cover, and thus, moved upward and spaced away from the main body. Further, the cover side transmission unit is moved away from the main body side transmission unit, thereby interrupting transmission of the drive force from the drive source to the first roller. Hence, in this sheet conveying device, when the jammed sheet is removed from the sheet conveying passage, the first roller nipping the jammed sheet with the second roller would not be an obstacle to removal of the jammed sheet. Therefore, the jammed sheet can be easily removed.

SUMMARY

However, in such a conventional sheet conveying device, in the state where the cover is at the open position, the connecting portion is exposed to the outside of the main body. At this time, external foreign materials may interfere with the connecting portion. For this reason, this type of sheet conveying device is required to improve its durability.

In view of the foregoing, it is an object of the present invention to provide a sheet conveying device capable of easily removing a jammed sheet when a sheet jam occurs in a sheet conveying passage at a position adjacent to the first roller and the second roller, and also capable of realizing improvement of its durability.

In order to attain the above and other objects, the present invention provides a sheet conveying device including: a main body; a cover; a first roller; a second roller; a drive source; a drive force transmission unit; and an interlocking assembly. The main body defines a conveying passage along which a sheet is conveyed. The cover is supported to the main body and movable between a closed position in which the cover covers the main body and an open position in which the cover is spaced away from the main body. The first roller is rotatably supported to the cover and configured to discharge the sheet from the conveying passage to an outside of the main body. The second roller is rotatably supported to one of the cover and the main body, and disposed in confrontation with the first roller while interposing the conveying passage between the first roller and the second roller when the cover is at the closed position. The second roller is configured to be driven by the first roller. The drive source is configured to generate a drive force. The drive force transmission unit is configured to transmit the drive force from the drive source to the first roller. The drive force transmission unit includes: a first transmission portion provided at the main body, and a second transmission portion provided at the cover. The first transmission portion and the second transmission portion is configured to be connected to each other to transmit the drive force from the drive source to the first roller through the first transmission portion and the second transmission portion when the cover is at the closed position. The first transmission portion and the second transmission portion is also configured to be spaced away from each other to interrupt transmission of the drive force from the drive source to the first roller when the cover is at the open position. The first transmission portion includes a connecting portion configured to be connected to the second transmission portion when the cover is at the closed position and also configured to be spaced away from the second transmission portion and exposed to an outside of the main body when the cover is at the open position. The interlocking assembly is disposed between the cover and the main body, and configured to be moved in interlocking relation to movement of the cover to a first position in response to the movement to the open position, and to a second position in response to the movement to the closed position. The interlocking assembly is positioned to cover the connecting portion when the interlocking assembly is at the first position.

According to another aspect, the present invention provides a sheet conveying device including: a main body; a cover; a first roller; and a second roller. The main body defines a conveying passage along which a sheet is conveyed. The cover is supported to the main body and movable between a closed position in which the cover covers the main body from above and an open position in which the cover is moved upward from the main body so as to be spaced away from the main body. The first roller is rotatably supported to the cover and configured to discharge the sheet from the conveying passage to an outside of the main body. The second roller is rotatably supported to the main body and disposed in confrontation with the first roller while interposing the conveying passage between the first roller and the second roller when the cover is at the closed position.

DETAILED DESCRIPTION

First Embodiment

An image forming apparatus as a sheet conveying device according to a first embodiment of the present invention will be described with reference to FIGS. 1 through 10. Throughout the specification, the terms "upward", "downward", "upper", "lower", "above", "below", "beneath", "right", "left", "front", "rear" and the like will be used assuming that the image forming apparatus 1 is disposed in an orientation in which it is intended to be used. More specifically, in FIG. 1, a side where an opening portion 89 and a movable tray 82 of the image forming apparatus 1 are disposed will be referred to as a front side, and a left side of the front side will be referred to as a left side.

<Overall Structure of Image Forming Apparatus>

Figure 1:
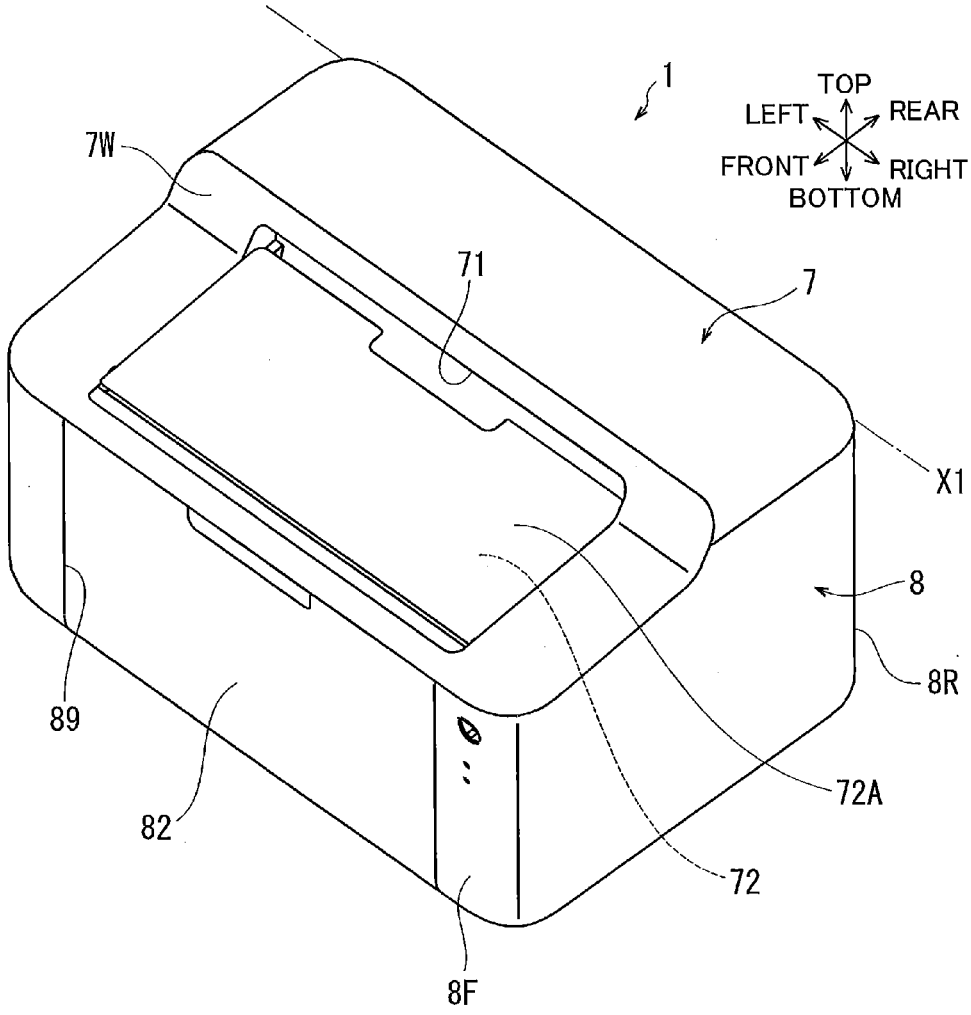
FIG. 1 is a perspective view of an image forming apparatus embodying a sheet conveying device according to a first embodiment of the present invention.
Figure 2:
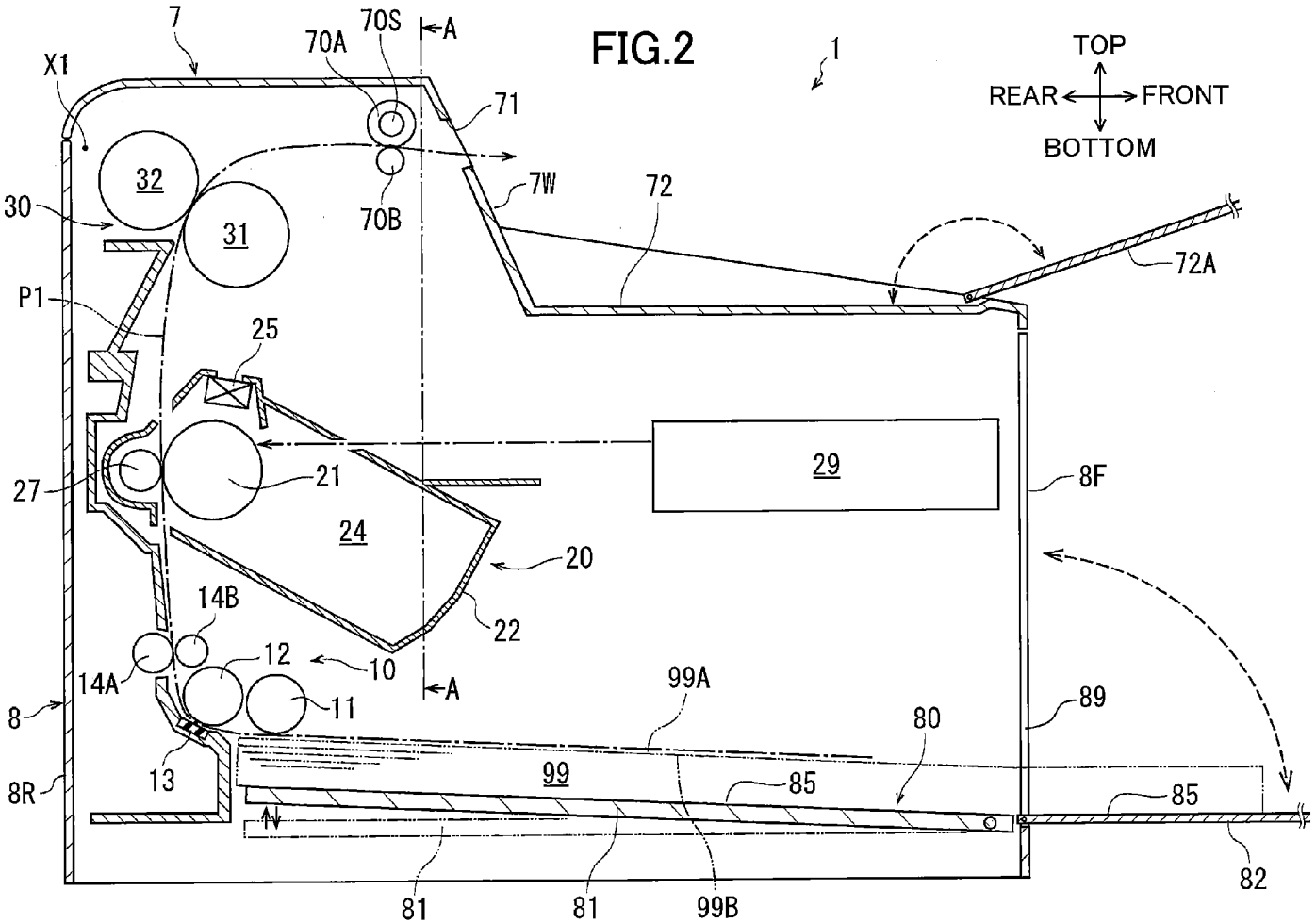
FIG. 2 is a schematic cross-sectional view of the image forming apparatus in FIG. 1.

Referring to FIGS. 1 and 2, the image forming apparatus 1 includes a main body 8, and a cover 7. In the main body 8, a sheet stacking portion 80, a sheet feeding unit 10, an image forming unit 20, a fixing unit 30, and a discharge driven roller 70B including a pair of driven roller segments are provided. The cover 7 is provided with a discharge drive roller 70A including a pair of drive roller segments.

As shown in FIG. 2, the main body 8 is formed in a generally box shape with a stepped top surface. The main body 8 has a front wall 8F and a rear wall 8R, and the rear wall 8R has a height greater than that of the front wall 8F. That is, a portion of the main body 8 at a rear wall 8R side has a height greater than a portion of the main body 8 at a front wall 8F side.

The front wall 8F has a lower portion formed with the opening portion 89 for providing communication between an interior and an exterior of the main body 8.

Figure 3:
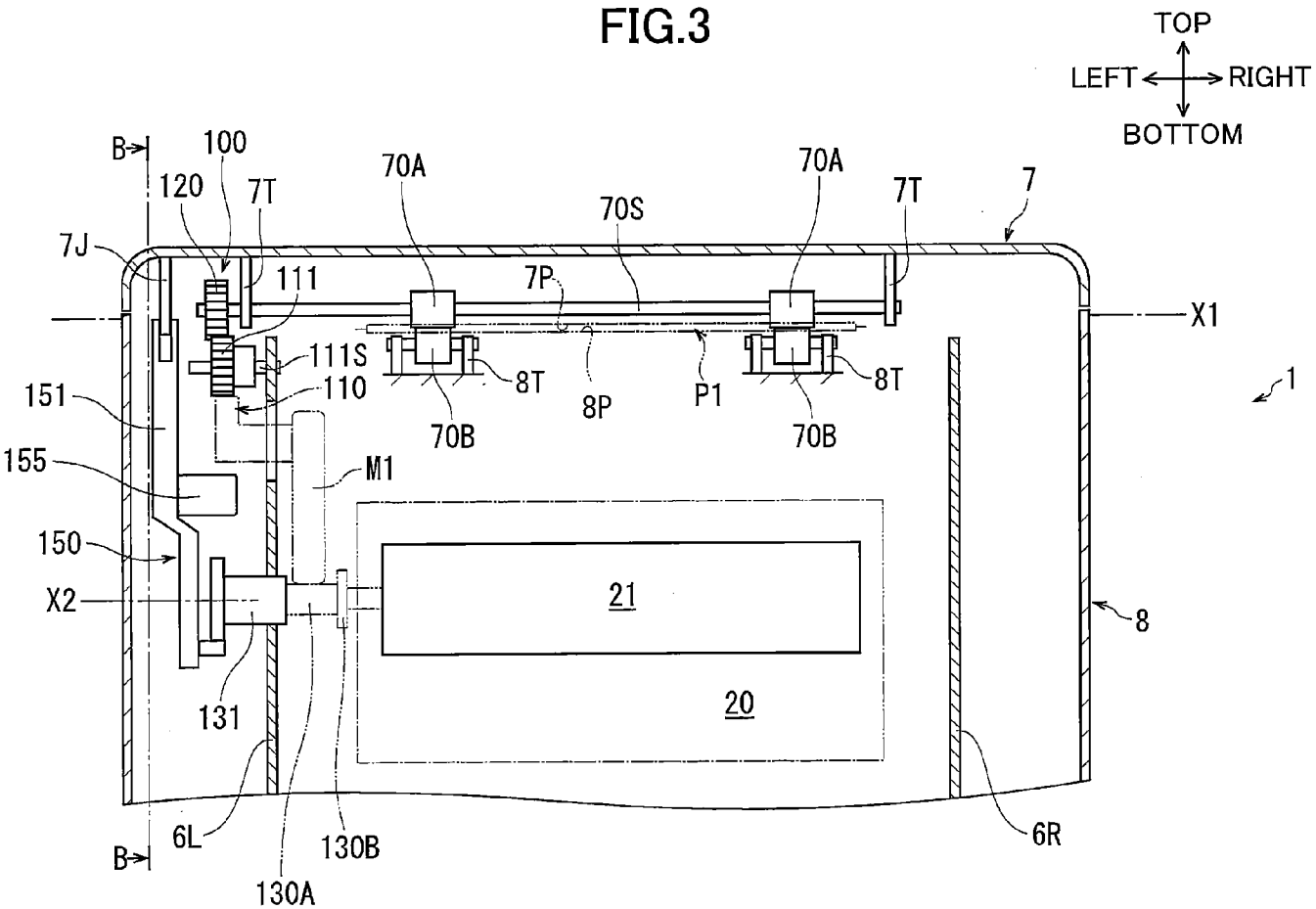
FIG. 3 is a partial schematic cross-sectional view of the image forming apparatus according to the first embodiment taken along a line A-A shown in FIG. 2, in which a cover of the image forming apparatus is at a closed position.

As shown in FIG. 3, within the main body 8, a right and left pair of inner side frames 6R, 6L and a frame member (not shown) are provided. The inner side frames 6R, 6L are respectively disposed spaced apart from and in confrontation with right and left side walls of the main body 8. The inner side frames 6R, 6L are respectively fixed to side walls of the main body 8. Each of the inner side frames 6R, 6L is formed in a generally flat plate shape extending in a vertical direction and in a frontward/rearward direction.

In the depicted embodiment, the term "generally flat plate shape" means that the configuration is generally flat, but may include a projection, a recess or a rib thereon. The same applies to the terms "generally vertical", "generally horizontal", and the like.

A drive source M1 is assembled to the left inner side frame 6L. The drive source M1 is adapted to supply a drive force to the sheet feeding unit 10, the image forming unit 20, the fixing unit 30, and the discharge drive roller 70A.

Figure 4:
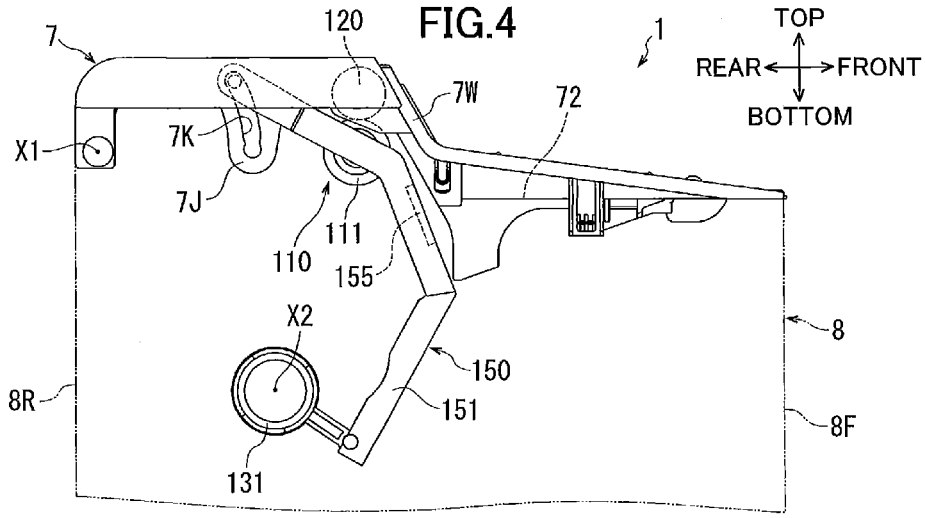
FIG. 4 is a partial schematic cross-sectional view of the image forming apparatus according to the first embodiment taken along a line B-B shown in FIG. 3, in which the cover is at the closed position.

As shown in FIGS. 1 through 3, the cover 7 is disposed at a top portion of the main body 8. As shown in FIG. 4, in a side view, the cover 7 extends in a generally horizontal direction from a rear side of the main body 8 toward a generally center portion of the cover 7 in the frontward/rearward direction, and then bends diagonally downward and frontward at the generally center portion, and further extends from the generally center portion diagonally downward and frontward. As described above, the cover 7 is bent into a generally crank shape in conformance with the stepped top surface of the main body 8.

Figure 5:
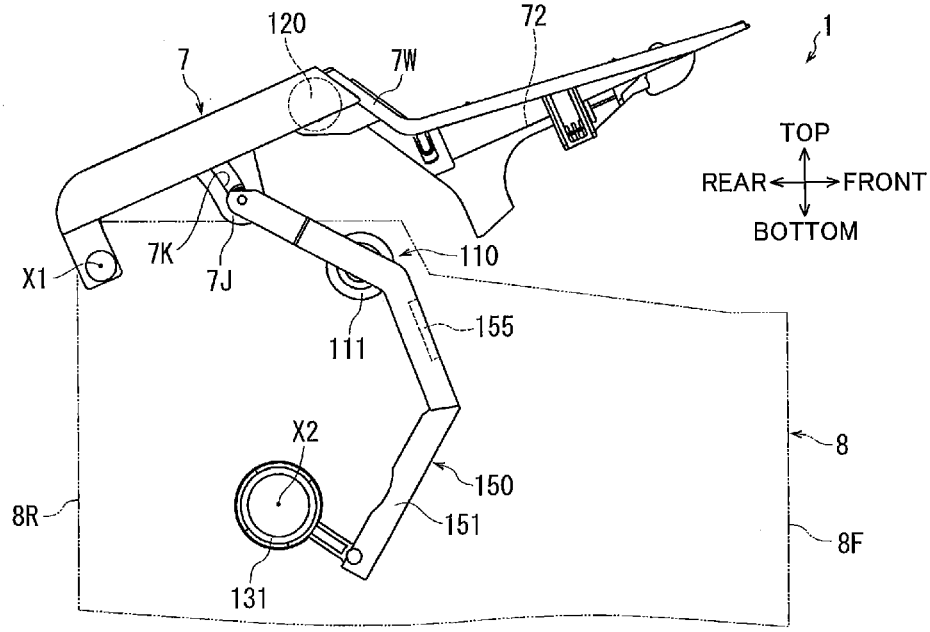
FIG. 5 is a partial schematic cross-sectional view of the image forming apparatus according to the first embodiment, similar to the view shown in FIG. 4, in which the cover is being moved from the closed position to an open position.
Figure 6:
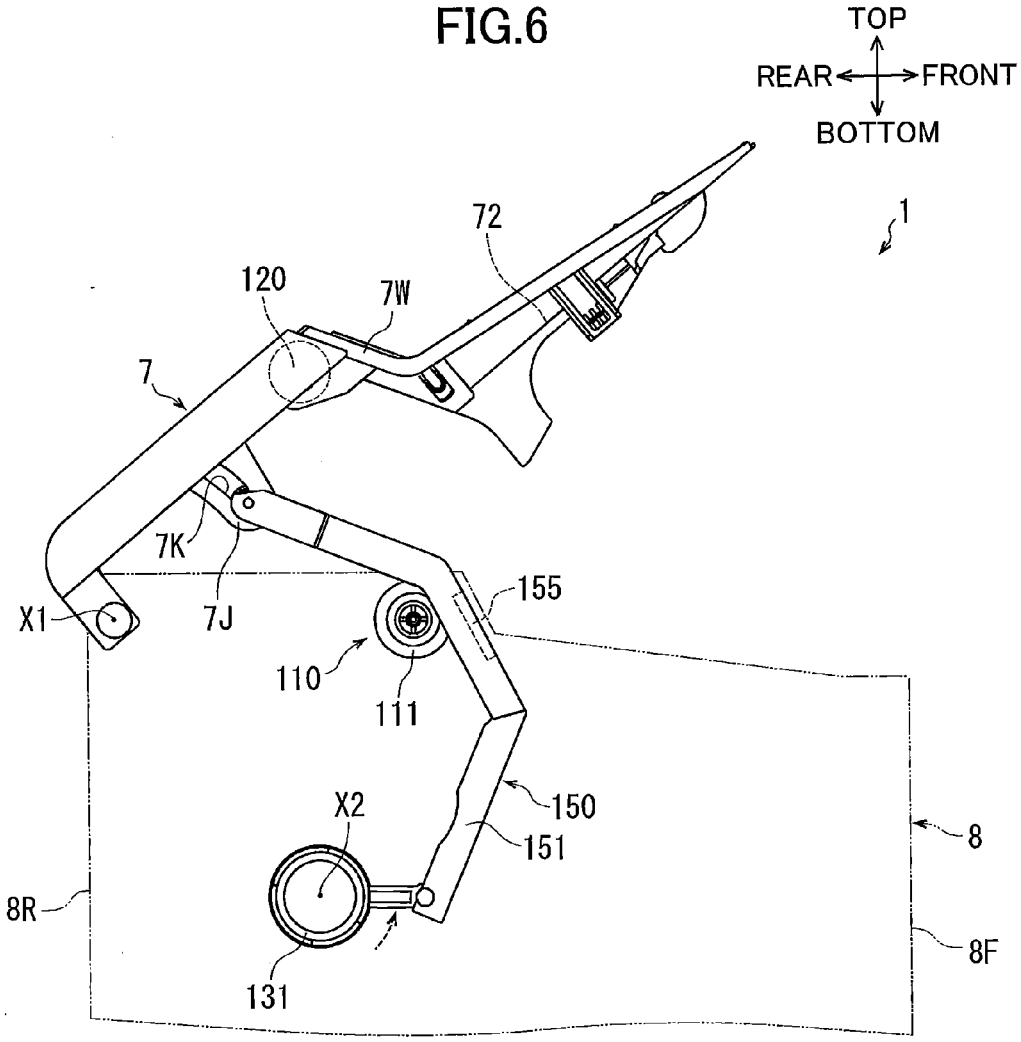
FIG. 6 is a partial schematic cross-sectional view of the image forming apparatus according to the first embodiment, similar to the view shown in FIG. 4, in which the cover is being moved from the closed position to the open position.

The cover 7 has a rear edge pivotally movably supported to the main body 8 about a pivot axis X1. The pivot axis X1 is provided at an upper edge of a portion of the main body 8 at the rear wall 8R side and extends in a rightward/leftward direction. With this configuration, the cover 7 is pivotally movable as shown in FIGS. 5 and 6 from a closed position shown in FIG. 4 where the cover 7 covers the main body 8 from above to an open position shown in FIG. 7 where the cover 7 is spaced away upwardly from the main body 8.

As shown in FIG. 2, the cover 7 has a top surface whose portion at the front wall 8F side is provided with a discharge tray 72. The cover 7 is further provided with a supplemental tray 72A. The supplemental tray 72A is supported to the cover 7, and pivotally movable about a front edge of the cover 7 between a covered position as shown in FIG. 1 where the supplemental tray 72A covers the discharge tray 72 from above and an exposed position as shown in FIG. 2 where the supplemental tray 72A extends frontward and the discharge tray 72 is exposed to an outside.

As shown in FIG. 2, the discharge tray 72 of the cover 7 has a rear edge having an upright wall 7W. The rear edge of the discharge tray 72 is bent upward to provide the upright wall 7W. The upright wall 7W has an upper portion formed with a discharge opening 71 for providing communication between an interior and an exterior of the main body 8.

As shown in FIG. 2, the sheet stacking portion 80 is provided at a bottom portion of the main body 8. The sheet stacking portion 80 includes the movable tray 82 and a pressure plate 81.

As shown in FIGS. 1 and 2, the movable tray 82 is formed in a generally flat plate shape and pivotally movably supported to a lower edge of the front wall 8F of the main body 8. The movable tray 82 closes the opening portion 89 when the movable tray 82 is in a vertically upright position as shown in FIG. 1, and opens the opening portion 89 when the movable tray 82 extends frontward and generally horizontally as shown in FIG. 2.

The pressure plate 81 has a generally flat plate configuration. The pressure plate 81 is disposed at the bottom portion of the main body 8 and extends in a generally horizontal direction. The pressure plate 81 has an upper surface defined as a stacking surface 85 on which a plurality of sheets 99 is placed in a stacked state. The movable tray 82 in a state where the opening portion 89 is open has an upper surface also defined as the stacking surface 85 in cooperation with the pressure plate 81. The sheet 99 placed on the stacking surface 85 has an upper surface onto which a toner image is transferred by the image forming unit 20. That is, the upper surface of the sheet 99 is defined as an image formed surface 99A. A surface of the sheet 99 opposite to the image formed surface 99A is defined as an opposite surface 99B.

The pressure plate 81 has a front edge pivotally movably supported to the main body 8. Further, the pressure plate 81 is connected to a moving mechanism (not shown) provided at the bottom portion of the main body 8. The moving mechanism is configured to move the pressure plate 81 so as to change an inclination angle of the pressure plate 81 as indicated by a solid line shown in FIG. 2 and a two-dot chain line shown in FIG. 2.

As shown in FIG. 2, the main body 8 has a conveying passage P1 along which each sheet 99 placed on the stacking surface 85 is conveyed. The conveying passage P1 extends from a front portion of the sheet stacking portion 80 (i.e. a front portion of the pressure plate 81 constituting the stacking surface 85) to a rear portion of the sheet stacking portion 80, and is curved upward at the rear wall 8R side of the main body 8 to extend in a generally vertical direction, and then, further curved frontward at a position below the cover 7 to extend toward the discharge opening 7, thereby reaching the discharge tray 72.

In short, the conveying passage P1 has a generally C-shaped configuration such that the conveying passage P1 is curved upward and then frontward to change its orientation from a direction from the front wall 8F toward the rear wall 8R (i.e. "feeding direction" described later) to a direction from the rear wall 8R toward the front wall 8F (i.e. "discharging direction" described later).

The image forming apparatus 1 includes, along the conveying passage P1, a sheet supply roller 11, a separation roller 12, a separation pad 13, a conveying roller 14A, a driven roller 14B, the image forming unit 20, the fixing unit 30, the discharge drive roller 70A, and the discharge driven roller 70B.

The sheet feeding unit 10 is disposed below the image forming unit 20, and includes the sheet supply roller 11, the separation roller 12, the separation pad 13, the conveying roller 14A and the driven roller 14B.

The sheet supply roller 11 is disposed above a rear portion of the pressure plate 81. The moving mechanism (not shown) moves the pressure plate 81 to change the inclination angle of the pressure plate 81 according to the number of sheets 99 stacked on the stacking surface 85, so that a topmost sheet 99 is contacted with the sheet supply roller 11.

The separation roller 12 and the separation pad 13 are disposed rearward of the sheet supply roller 11 at positions where the conveying passage P1 changes its orientation upward. The separation pad 13 is in confrontation with the separation roller 12, interposing the conveying passage P1 therebetween. The separation pad 13 is pressed toward the separation roller 12. The conveying roller 14A and the driven roller 14B are disposed above the separation roller 12. The driven roller 14B is in confrontation with the conveying roller 14A, interposing the conveying passage P1 therebetween. The driven roller 14B is rotated in association with rotation of the conveying roller 14A.

The image forming unit 20 includes a process cartridge 22 and a scanner unit 29.

The process cartridge 22 is formed in a generally box shape extending in the rightward/leftward direction. A generally vertically extending portion of the conveying passage P1 extends through an interior of the process cartridge 22. The process cartridge 22 is assembled to the frame member (not shown) of the main body 8. Within the process cartridge 22, a photosensitive drum 21, a transfer roller 27, a toner accommodating portion 24, and a charger 25 are provided. The toner accommodating portion 24 is adapted to supply toner to the photosensitive drum 21. The charger 25 is adapted to positively charge the photosensitive drum 21 by corona discharge.

The photosensitive drum 21 has a cylindrical configuration extending in the rightward/leftward direction. The photosensitive drum 21 is disposed frontward of and in confrontation with the generally vertically extending portion of the conveying passage P1. The transfer roller 27 is in confrontation with the photosensitive drum 21, interposing the conveying passage P1 therebetween. The photosensitive drum 21 and the transfer roller 27 rotate synchronously while nipping the sheet 99 conveyed in the generally vertically extending portion of the conveying passage P1. The charger 25 is disposed above and spaced apart from the photosensitive drum 21, and extends in a direction parallel to the photosensitive drum 21 (i.e. the rightward/leftward direction).

The scanner unit 29 is disposed frontward of the process cartridge 22. The scanner unit 29 is provided with a laser source, a polygon mirror, an fθ lens, and a reflection mirror. The scanner unit 29 is adapted to emit a laser beam to expose the photosensitive drum 21 to the laser beam from front.

The fixing unit 30 is disposed above the photosensitive drum 21 and the transfer roller 27 at the generally vertically extending portion of the conveying passage P1. The fixing unit 30 includes a heating roller 31 and a pressure roller 32. The heating roller 31 faces the conveying passage P1 from front. The pressure roller 32 is in confrontation with the heating roller 31, interposing the conveying passage P1 therebetween.

The discharge drive roller 70A and the discharge driven roller 70B are disposed at a most downstream side of the conveying passage P1 and face the discharge opening 71. In other words, the discharge drive roller 70A and the discharge driven roller 70B are provided at positions where the conveying passage P1 changes its orientation to extend frontward. As shown in FIG. 3, the conveying passage P1 has an upper guide surface 7P and a lower guide surface 8P at the most downstream side. The upper guide surface 7P and the lower guide surface 8P are adapted to guide the sheet 99 to the discharge opening 71. The upper guide surface 7P is provided at the cover 7. The lower guide surface 8P is provided at the main body 8.

The discharge drive roller 70A is fixed to a rotation shaft 70S, so that the discharge drive roller 70A can rotate integrally with the rotation shaft 70S. The rotation shaft 70S extends in a widthwise direction of the sheet 99 discharged from the discharge opening 71 to the discharge tray 72, that is, in the rightward/leftward direction. The rotation shaft 70S is rotatably supported to a pair of roller support portions 7T provided at the cover 7. With this configuration, as shown in FIG. 2, the discharge drive roller 70A is positioned above the conveying passage P1 (i.e. at a side of the upper guide surface 7P shown in FIG. 3) and adapted to contact the opposite surface 99B which is opposite to the image formed surface 99A of the sheet 99 conveyed in the conveying passage P1. The discharge drive roller 70A is rotated by a drive force transmitted from the drive source M1 through a drive force transmission unit 100 (described later).

As shown in FIG. 3, each roller segment of the discharge driven roller 70B is rotatably supported to a roller support portion 8T provided at an inner frame (not shown) of the main body 8. When the cover 7 is at the closed position, the discharge driven roller 70B is positioned below the discharge drive roller 70A. The discharge driven roller 70B is urged toward the discharge drive roller 70A by an urging member (not shown) connected to the roller support portion 8T. With this configuration, as shown in FIG. 2, the discharge driven roller 70B is positioned below the conveying passage P1 (i.e. at a side of the lower guide surface 8P shown in FIG. 3), and confronts the discharge drive roller 70A, interposing the conveying passage P1 between the discharge drive roller 70A and the discharge driven roller 70B. The discharge driven roller 70B is rotated in association with rotation of the discharge drive roller 70A. That is, the discharge driven roller 70B is configured to be driven by the discharge drive roller 70A.

<Drive Force Transmission Unit>

As shown in FIG. 3, the image forming apparatus 1 includes the drive force transmission unit 100. The drive force transmission unit 100 is adapted to transmit a drive force from the drive source M1 provided at the main body 8 to the discharge drive roller 70A provided at the cover 7.

More specifically, the drive force transmission unit 100 includes a main body side transmission portion 110 provide at the main body 8 and a cover side transmission portion 120 provided at the cover 7.

Well-known drive force transmission members, such as a gear and a set of a pulley and a belt, constitute the main body side transmission portion 110. The main body side transmission portion 110 is supported to the left inner side frame 6L. The main body side transmission portion 110 has one end portion connected to the drive source M1 and another end portion provided with a connecting portion 111. The other end portion of the main body side transmission portion 110 is positioned at a side farthest from the drive source M1. In the depicted embodiment, the connecting portion 111 is a spur gear. The connecting portion 111 is rotatably supported to a support shaft 111S protruding leftward from an upper edge of the left inner side frame 6L.

Figure 8:
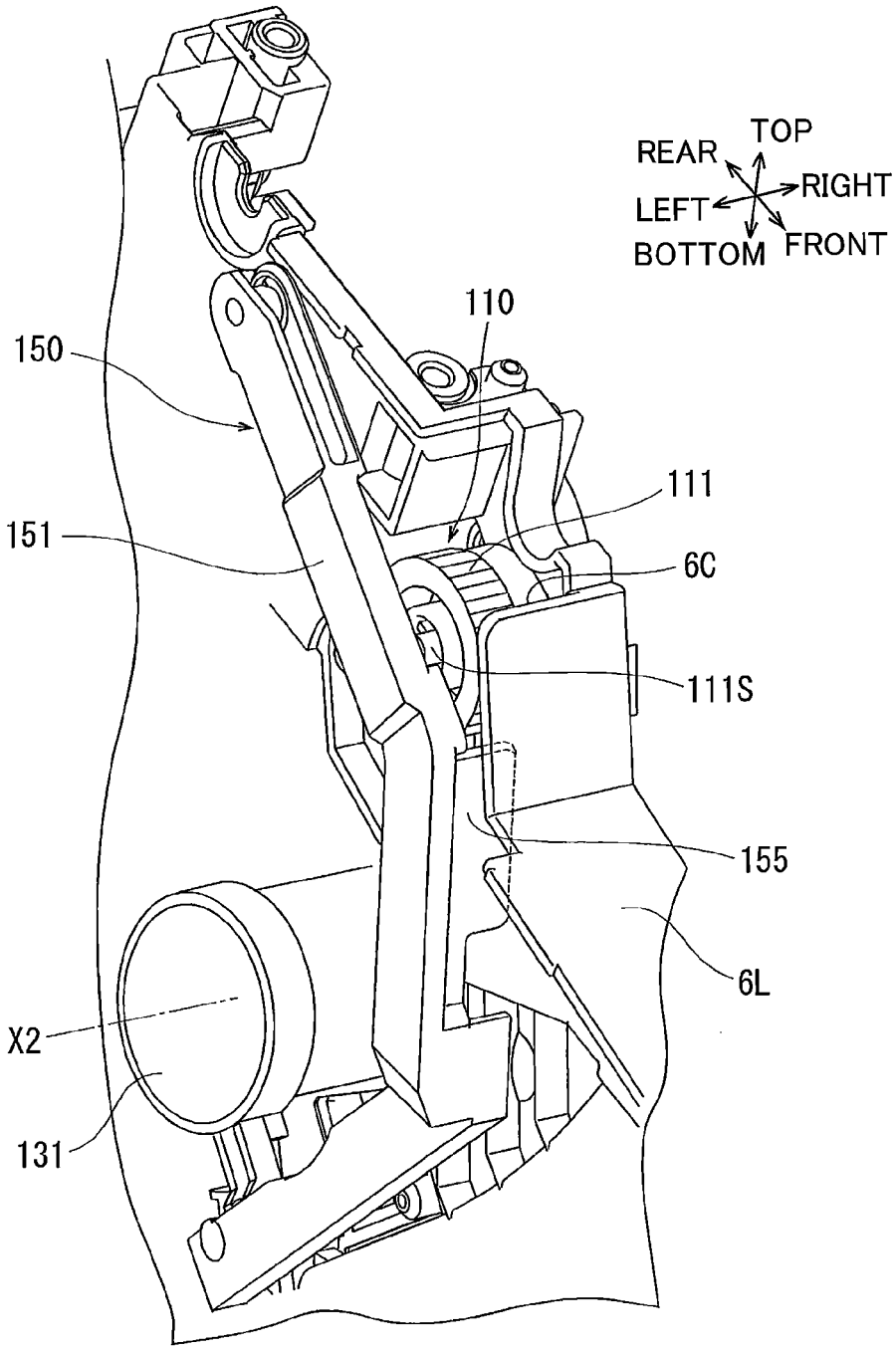
FIG. 8 is a partial perspective view showing a relative positional relationship between a cover portion of an interlocking assembly and a connecting portion, both provided in the image forming apparatus according to the first embodiment, in a state where the cover is at the closed position.

As shown in FIG. 8, the left inner side frame 6L is formed with a notch 6C at a position above the connecting portion 111.

In the depicted embodiment, the cover side transmission portion 120 is a spur gear. As shown in FIG. 3, the cover side transmission portion 120 is fixed to a left end portion of the rotation shaft 70S, so that the cover side transmission portion 120 can rotate integrally with the rotation shaft 70S. When the cover 7 is at the closed position, the cover side transmission portion 120 is in meshing engagement with the connecting portion 111 from above.

Incidentally, although the cover side transmission portion 120 is not shown in FIG. 8, the cover side transmission portion 120 is meshingly engaged with the connecting portion 111 through the notch 6C when the cover 7 is at the closed position.

As shown in FIGS. 2 and 4, meshing engagement of the connecting portion 111 of the main body side transmission portion 110 and the cover side transmission portion 120 in a state where the cover 7 is at the closed position allows the drive force from the drive source M1 to be transmitted to the discharge drive roller 70A through the cover side transmission portion 120 and the main body side transmission portion 110.

Figure 7:
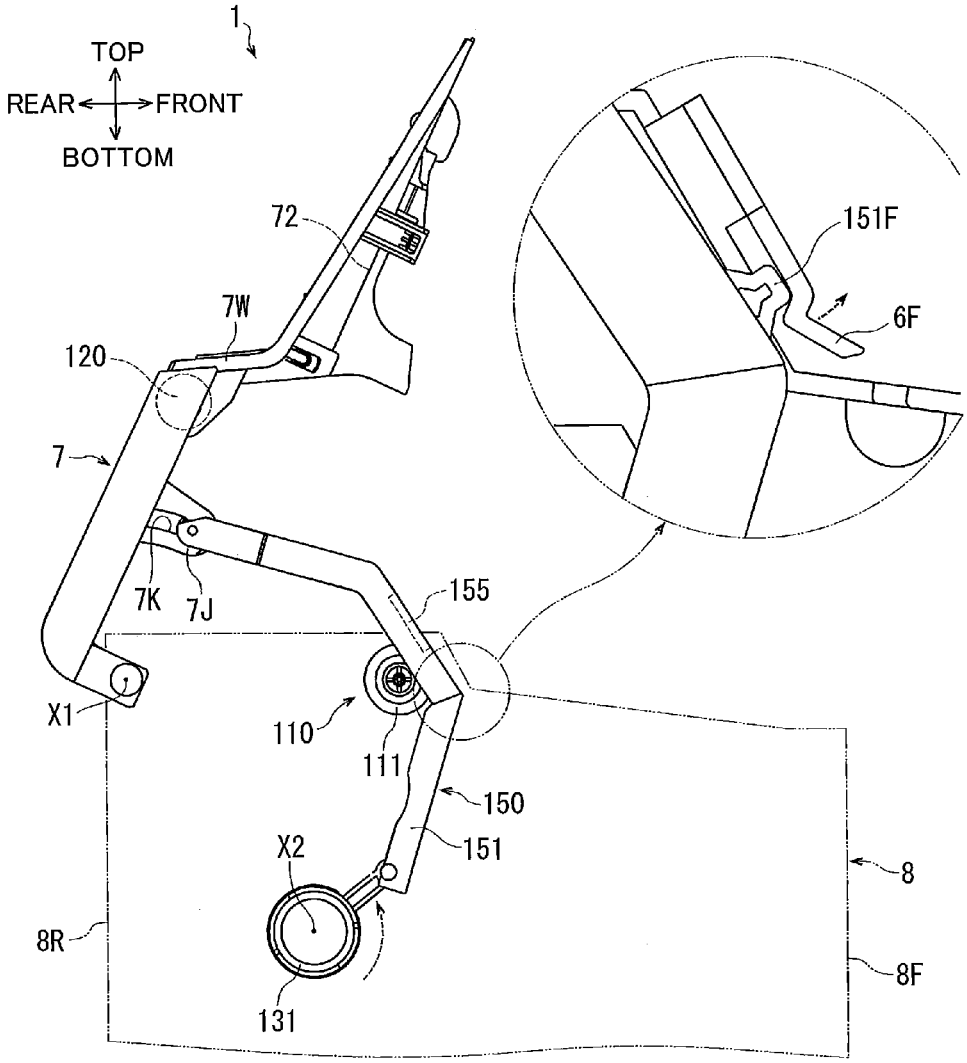
FIG. 7 is a partial schematic cross-sectional view of the image forming apparatus according to the first embodiment, similar to the view shown in FIG. 4, in which the cover is at the open position.
Figure 9:
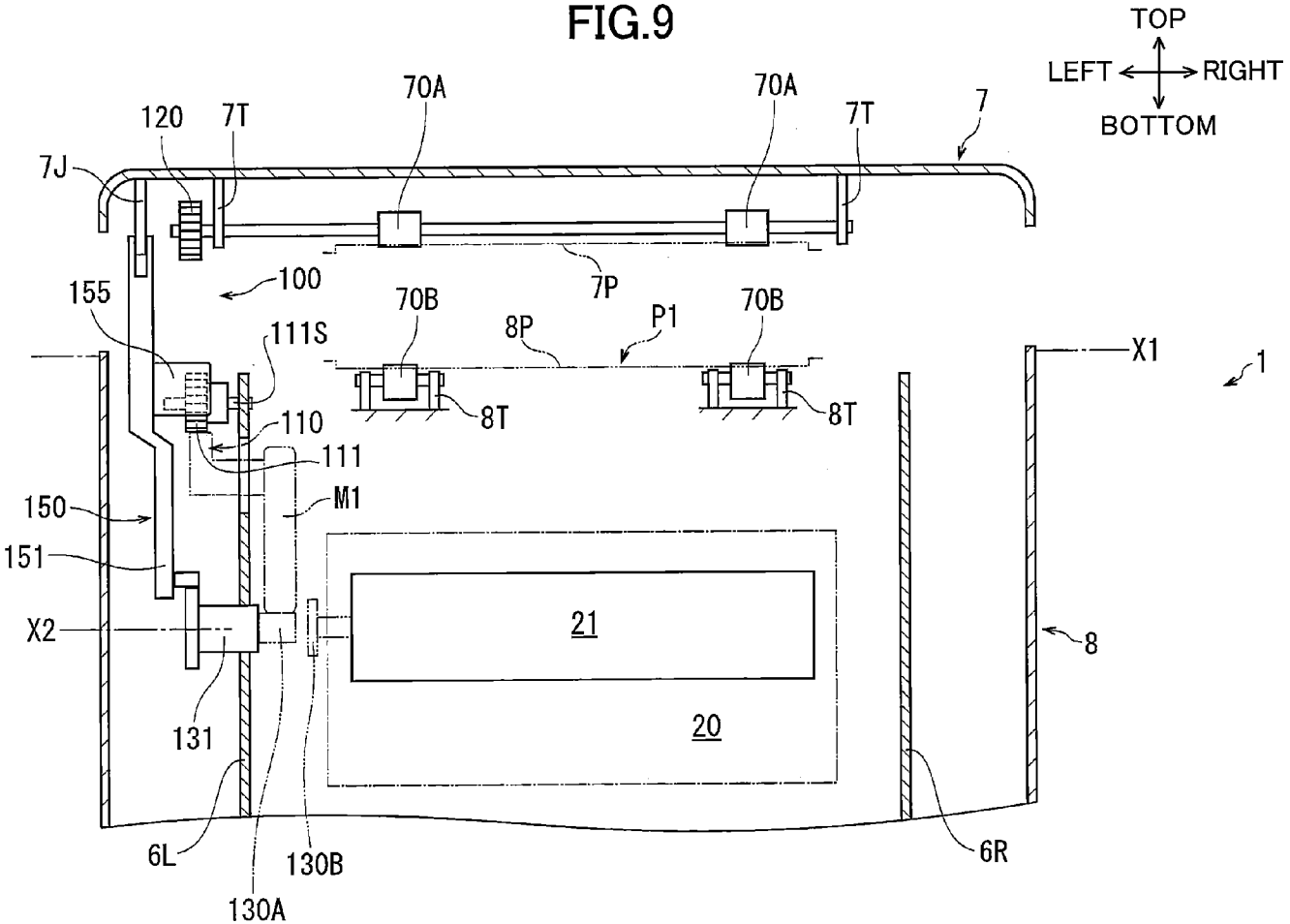
FIG. 9 is a partial schematic cross-sectional view of the image forming apparatus according to the first embodiment, similar to the view shown in FIG. 3, in which the cover is at the open position.
Figure 10:
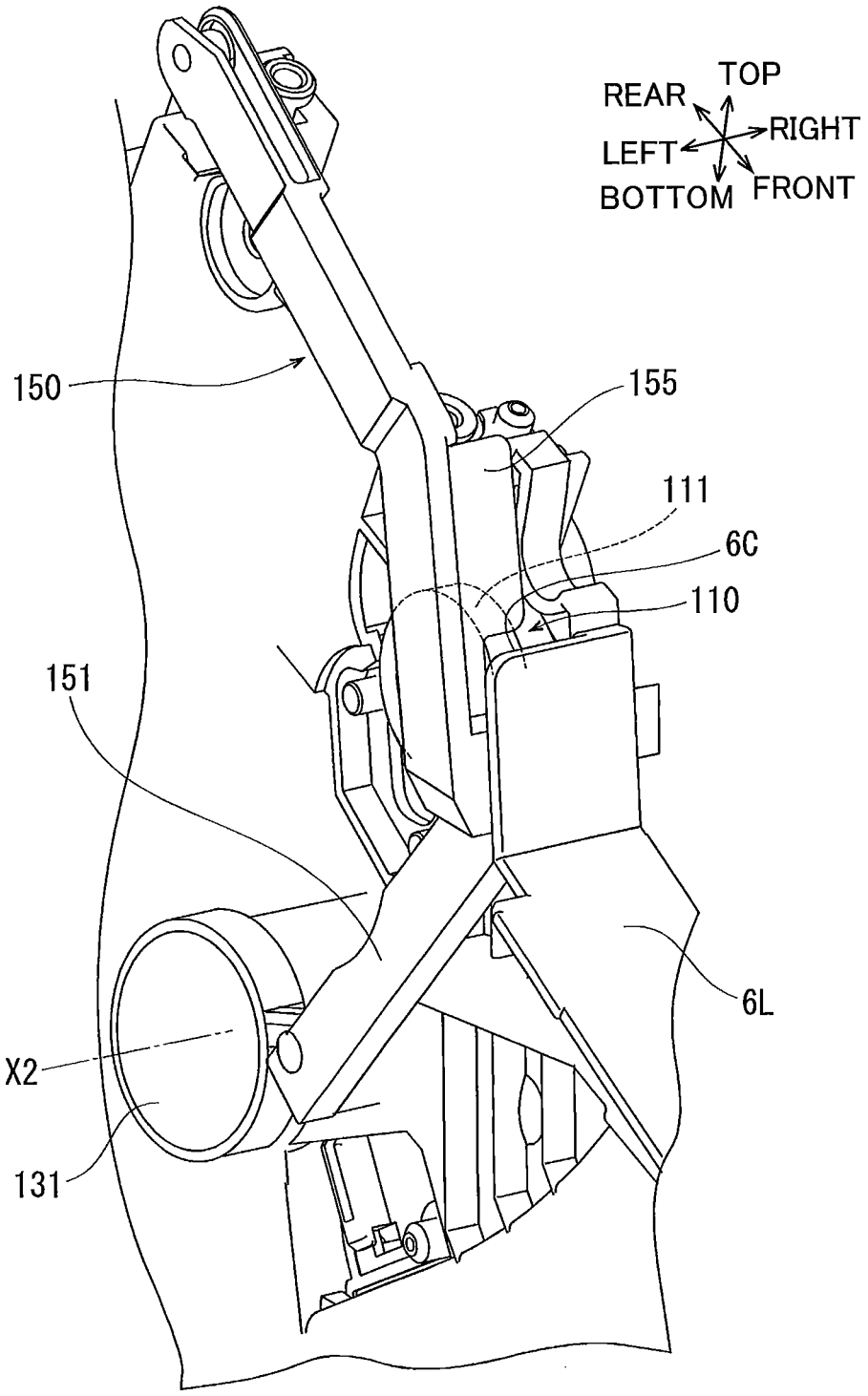
FIG. 10 is a partial perspective view showing a relative positional relationship between the cover portion of the interlocking assembly and the connecting portion in a state where the cover is at the open position.

As shown in FIGS. 5 to 7, pivotal upward movement of the cover 7 moves the cover side transmission portion 120 spaced away from and upward from the main body side transmission portion 110, since the cover side transmission portion 120 is supported to the cover 7. Further, as shown in FIGS. 7, 9, and 10, when the cover 7 is at the open position, the cover side transmission portion 120 is spaced away from the connecting portion 111 of the main body side transmission portion 110, thereby releasing meshing engagement of the cover side transmission portion 120 with the connecting portion 111. As a result, transmission of the drive force from the drive source M1 to the discharge drive roller 70A is interrupted.

FIG. 10 delineates a cover portion 155 of an interlocking assembly 150 (described later). Assuming that the image forming apparatus 1 is not provided with the cover portion 155, the connecting portion 111 of the main body side transmission portion 110 is exposed to an outside of the main body 8 through the notch 6C when the cover 7 is at the open position.

<Interlocking Assembly>

As shown in FIGS. 3 and 4, the image forming apparatus 1 includes the interlocking assembly 150. The interlocking assembly 150 is disposed between the cover 7 and the main body 8. The interlocking assembly 150 includes a link arm portion 151 and the cover portion 155.

The link arm portion 151 is positioned leftward of each of the left inner side frame 6L, the main body side transmission portion 110 and the cover side transmission portion 120. That is, the link arm portion 151 is positioned outward of each of the left inner side frame 6L, the main body side transmission portion 110 and the cover side transmission portion 120 in the widthwise direction. As shown in FIG. 3, the link arm portion 151 is positioned so as not to overlap the connecting portion 111 in the rightward/leftward direction. In other words, the link arm portion 151 is positioned so as to be offset from the connecting portion 111 in the rightward/leftward direction. Further, as shown in FIG. 3, when viewing from a front side of the main body 8, the link arm portion 151 has an elongated configuration extending in the vertical direction. Further, as shown in FIG. 4, when viewing from a left side of the main body 8, the link arm portion 151 is bent so that an intermediate portion thereof in the vertical direction protrudes frontward.

In the depicted embodiment, the discharging direction in which the sheet 99 is discharged from the discharge opening 71 to the discharge tray 72 is a rear-to-front direction. Further, the feeding direction in which the sheet 99 is fed by the sheet feeding unit 10 is a front-to-rear direction. That is, the feeding direction is a direction opposite to the discharging direction. Further, in the depicted embodiment, a direction perpendicular to a surface of the sheet 99 discharged in the discharging direction from the conveying passage P1 is a vertical direction. Further, in the depicted embodiment, the widthwise direction perpendicular to the discharging direction of the sheet 99 is a rightward/leftward direction.

Further, in the depicted embodiment, the term "inward in the widthwise direction" means a direction toward a center portion of the main body 8 from one of the right and left inner side frames 6R, 6L in the rightward/leftward direction and the term "outward in the widthwise direction" means a direction toward one of the right and left inner side frames 6R, 6L from the center portion of the main body 8 in the rightward/leftward direction.

As shown in FIGS. 3 and 4, the link arm portion 151 has an upper end portion connected to an elongated hole 7K formed in an engagement portion 7J of the cover 7. The engagement portion 7J is formed so as to protrude downward from a left end portion of the cover 7. The link arm portion 151 has a lower end portion connected to a slide mechanism 131 of the main body 8. The slide mechanism 131 is a well-known converting mechanism for converting rotational movement to linear movement.

The cover portion 155 is integral with the link arm portion 151 and disposed at the intermediate portion of the link arm portion 151 in the vertical direction. The cover portion 155 is formed in a flat plate shape. The cover portion 155 protrudes rightward from the intermediate portion. That is, the cover portion 155 protrudes inward from the link arm portion 151 in the widthwise direction. As shown in FIG. 3, when the cover 7 is at the closed position, the cover portion 155 is positioned immediately below the connecting portion 111 with respect to the rightward/leftward direction.

As shown in FIG. 3, the slide mechanism 131 is supported to the left inner side frame 6L and pivotally movable about a pivot axis X2 extending in the rightward/leftward direction. The slide mechanism 131 is disposed leftward of the photosensitive drum 21. A first coupling 130A and a second coupling 130B are disposed between the slide mechanism 131 and the photosensitive drum 21. The second coupling 130B has a right end fixedly coupled to the photosensitive drum 21, so that the second coupling 130B can rotate integrally with the photosensitive drum 21. The first coupling 130A has an upper portion connected to the drive source M1. Further, the first coupling 130A has a right end in confrontation with and coupled to a left end of the second coupling 130B, and a left end coupled to the slide mechanism 131.

When the cover 7 is at the closed position, the link arm portion 151 and the slide mechanism 131 are positioned as shown in FIG. 4. In this state, the upper end portion of the link arm portion 151 is positioned at an upper end of the elongated hole 7K. Further, as shown in FIG. 3, the first coupling 130A and the second coupling 130B are coupled to each other. Hence, the drive force of the drive source M1 can be transmitted to the photosensitive drum 21 through the first coupling 130A and the second coupling 130B.

On the other hand, when the cover 7 is being pivotally moved to the open position as shown in FIGS. 5 to 7, the interlocking assembly 150 and the slide mechanism 131 are moved as described below.

Initially, when the cover 7 is moved to a state shown in FIG. 5, the elongated hole 7K is moved upward relative to the upper end portion of the link arm portion 151. As a result, a lower end of the elongated hole 7K is brought into abutment with the upper end portion of the link arm portion 151. Then, as shown in FIGS. 6 and 7, when the cover 7 is further moved from the state shown in FIG. 5, the upper end portion of the link arm portion 151 is lifted upward by the lower end of the elongated hole 7K, thereby pivotally moving the slide mechanism 131 about the pivot axis X2 to move the first coupling 130A leftward. Then, when the cover 7 is at the open position as shown in FIG. 7, the first coupling 130A is spaced away from the second coupling 130B to interrupt transmission of the drive force from the drive source M1 to the photosensitive drum 21 as shown in FIG. 9.

Further, as shown in FIG. 7 as an enlarged view of a portion marked by a circle therein, the left inner side frame 6L is provided with an engaging portion 6F formed of a leaf spring, and the intermediate portion of the link arm portion 151 is provided with a projection 151F. When the cover 7 is at the open position, the 151F is engaged with the engaging portion 6F. Hence, the cover 7 can be maintained at the open position.

Further, as shown in FIGS. 5 to 7, when the link arm portion 151 is lifted upward in association with pivotal upward movement of the cover 7, the cover portion 155 is also moved upward, passing through the notch 6C. Consequently, as shown in FIGS. 7, 9, and 10, when the cover 7 is at the open position, the cover portion 155 is positioned so as to cover the connecting portion 111.

To summarize, when the cover 7 is moved to the open position, the interlocking assembly 150 is moved to a first position shown in FIG. 7, and when the cover 7 is moved to the closed position, the interlocking assembly 150 is moved to a second position shown in FIG. 4. When the interlocking assembly 150 is at the first position, the cover portion 155 covers the connecting portion 111, the coupling 130A is spaced away from the coupling 130B, and the projection 151F is engaged with the engaging portion 6F. When the interlocking assembly 150 is at the second position, the cover portion 155 is positioned below the connecting portion 111, the coupling 130A is coupled to the coupling 130B, and the projection 151F releases engagement with the engaging portion 6F.

<Image Forming Operation>

The image forming apparatus 1 forms an image on the sheet 99 placed on the stacking surface 85 as described below.

When a control unit (not shown) provided in the image forming apparatus 1 controls the sheet feeding unit 10 to start operating, the sheet supply roller 11 conveys the sheets 99 stacked on the stacking surface 85 to the conveying passage P1. The separation roller 12 and the separation pad 13 separate the conveyed sheets 99 one by one. The conveying roller 14A and the driven roller 14B convey each separated sheet 99 to the image forming unit 20.

When the image forming unit 20 starts, operating in accordance with conveyance of the sheets 99 by the sheet feeding unit 10, a surface of the photosensitive drum 21 is uniformly charged by the charger 25 to have positive polarity while rotating, and then, the surface is exposed to a laser beam by the scanner unit 29. Hence, the scanner unit 29 forms, on the surface of the photosensitive drum 21, an electrostatic latent image corresponding to an image to be formed.

Next, toner accommodated in the toner accommodating portion 24 is supplied to the electrostatic latent image formed on the surface of the photosensitive drum 21. As a result, a toner image corresponding to the electrostatic latent image is formed on the surface of the photosensitive drum 21. The photosensitive drum 21 contacts the image formed surface 99A of the sheet 99 while rotating, thereby transferring the toner image onto the image formed surface 99A by a negative voltage applied to the transfer roller 27.

The sheet 99 onto which the toner image has been transferred is further conveyed generally vertically in the conveying passage P1, and reaches the fixing unit 30. In the fixing unit 30, the heating roller 31 heats the sheet 99 while the pressure roller 32 presses the sheet 99 against the heating roller 31. Accordingly, the fixing unit 30 thermally fixes the toner image onto the sheet 99.

Then, the sheet 99 is conveyed to the discharge drive roller 70A and the discharge driven roller 70B. The discharge drive roller 70A to which the drive force of the drive source M1 is transmitted through the drive force transmission unit 100 is positioned opposite to the image formed surface 99A of the sheet 99 with respect to the opposite surface 99B of the sheet 99. That is, the discharge drive roller 70A contacts the opposite surface 99B of the sheet 99 while rotating.

Further, the discharge driven roller 70B is driven by the discharge drive roller 70A and rotated in association with rotation of the discharge drive roller 70A. As a result, the sheet 99 is discharged to the discharge tray 72 through the discharge opening 71 by the discharge drive roller 70A and the discharge driven roller 70B. Thus, the image forming apparatus 1 completes the image forming operation with respect to the sheet 99.

<Advantageous Effects>

In the image forming apparatus 1 according to the above-described first embodiment, when the sheet 99 is jammed in the conveying passage P1 at a position adjacent to the discharge drive roller 70A and the discharge driven roller 70B, the jammed sheet 99 can be removed therefrom as described below.

Initially, as shown in FIGS. 5 to 7, the cover 7 is pivotally moved to the open position. At this time, the projection 151F is brought into engagement with the engaging portion 6F, thereby maintaining the cover 7 at the open position shown in FIG. 7.

As shown in FIGS. 7 and 9, when the cover 7 is at the open position, the discharge drive roller 70A is moved integrally with the cover 7 and the upper guide surface 7P, and thus, moved upward from and away from the discharge driven roller 70B and the lower guide surface 8P. As a result, the conveying passage P1 is exposed to an outside.

Further, when the cover 7 is at the open position, the connecting portion 111 of the main body side transmission portion 110 and the cover side transmission portion 120 are spaced away from each other in the vertical direction. Thus, transmission of the drive force from the drive source M1 to the discharge drive roller 70A can be interrupted. Accordingly, the discharge drive roller 70A is independently rotatable relative to the drive source M1.

Consequently, in the image forming apparatus 1 according to the above-described first embodiment, the discharge drive roller 70A does not obstruct removal of the jammed sheet 99. Further, in the image forming apparatus 1 according to the above-described first embodiment, when the cover 7 is moved from the closed position to the open position, the discharge drive roller 70A which has been contacted with the discharge driven roller 70B is moved away from the discharge driven roller 70B. Therefore, the jammed sheet 99 can be easily removed.

Accordingly, in the image forming apparatus 1 according to the above-described first embodiment, when the sheet 99 is jammed in the conveying passage P1 at a position adjacent to the discharge drive roller 70A and the discharge driven roller 70B, the jammed sheet 99 can be easily removed.

Further, in the image forming apparatus 1 according to the above-described first embodiment, when the cover 7 is at the open position, the cover portion 155 of the interlocking assembly 150 covers, from above, the connecting portion 111 exposed to an outside of the main body 8 through the notch 6C as shown in FIG. 10. Accordingly, this configuration can prevent external foreign materials from interfering with the connecting portion 111. As a result, the image forming apparatus 1 according to the above-described first embodiment can realize improvement on its durability.

Further, in the image forming apparatus 1 according to the above-described first embodiment, the link arm portion 151 has an elongated configuration extending in a direction perpendicular to the surface of the sheet 99 discharged from the conveying passage P1, that is, in the vertical direction. With this configuration, as shown in FIGS. 7 and 9, when the cover 7 is at the open position, the link arm portion 151 extends toward the main body 8 from the cover 7 which is spaced away from and upward of the main body 8. Hence, the interlocking assembly 150 can reliably cover the connecting portion 111 provided at the main body 8.

Further, in the image forming apparatus 1 according to the above-described first embodiment, the link arm portion 151 is positioned leftward of the connecting portion 111, that is, outward of the connecting portion 111 in the widthwise direction. Further, the cover portion 155 extends rightward from the link arm portion 151, that is, inward from the link arm portion 151 in the widthwise direction. This configuration allows the interlocking assembly 150 to be easily positioned alongside a side wall of the main body 8. Hence, the image forming apparatus 1 according to the above-described first embodiment allows layout of the interlocking assembly 150 in the main body 8 to be more compact.

Further, in the image forming apparatus 1 according to the above-described first embodiment, the interlocking assembly 150 is movable to cover and to uncover the connecting portion 111 in interlocking relation to the opening and closing movement of the cover 7. In addition, the interlocking assembly 150 causes the first coupling 130A to be separated from and coupled to the second coupling 130B in interlocking relation to the opening and closing movement of the cover 7. The interlocking assembly 150 also serves to maintain the cover 7 at the open position. With this configuration, the number of parts and components can be reduced in the image forming apparatus 1 according to the above-described first embodiment, compared with a case where a link mechanism for performing an operation different from an operation covering the connecting portion 111 is provided separately from the interlocking assembly 150.

Further, in the image forming apparatus 1 according to the above-described first embodiment, when the cover 7 is at the open position, the interlocking assembly 150 moves the first coupling 130A away from the second coupling 130B, so that transmission of the drive force from the drive source M1 to the photosensitive drum 21 is interrupted. Hence, the photosensitive drum 21 is rotatable independently from the drive source M1. As a result, in the image forming apparatus 1 according to the above-described first embodiment, the sheet 99 jammed in the conveying passage P1 around the photosensitive drum 21 can also be easily removed.

Further, in the image forming apparatus 1 according to the above-described first embodiment, the discharge drive roller 70A is positioned opposite to the image formed surface 99A with respect to the opposite surface 99B of the sheet 99 conveyed in the conveying passage P1. With this configuration, the discharge drive roller 70A as a drive roller discharges the sheet 99 while contacting the opposite surface 99B of the sheet 99 which is the surface onto which a toner image is not transferred. Hence, compared with a case where the discharge drive roller 70A discharges the sheet 99 while contacting the image formed surface 99A, the image formed on the image formed surface 99A is unlikely to be degraded. Thus, quality of an image formed on the sheet 99 can be improved.

Further, in the image forming apparatus 1 according to the above-described first embodiment, the conveying passage P1 from the sheet feeding unit 10 toward the outside of the main body 8 through the image forming unit 20, the discharge drive roller 70A and the discharge driven roller 70B has a curved configuration extending in the feeding direction, curved upward, and then, extending in the discharging direction. That is, the conveying passage P1 has a generally C-shaped configuration. Hence, compared with a case where the conveying passage P1 has a generally S-shaped configuration in which, for example, the sheet is fed in a rear-to-front direction (which is the same as the discharging direction of the sheet) in the sheet feeding unit and the passage is bent to extend in the direction opposite to the discharging direction from the direction the same as the discharging direction and again bent to extend in the discharging direction, a processing duration from sheet-feeding to discharging through image-forming can be shortened as little as possible.

Second Embodiment

An image forming apparatus 201 according to a second embodiment of the present invention will be next described while referring to FIGS. 11 to 16 wherein like parts and components are designated by the same reference numerals as those shown in the first embodiment to avoid duplicating description.

In the image forming apparatus 1 according to the first embodiment, the discharge driven roller 70B is rotatably supported to the main body 8. However, in the image forming apparatus 201 according to the second embodiment, the discharge driven roller 70B is rotatably supported to the cover 7. Further, in the image forming apparatus 201 according to the second embodiment, an actuator 260 is provided. Further, in the image forming apparatus 201 according to the second embodiment, an interlocking assembly 150 further includes an actuator cover 256.

Figure 11:
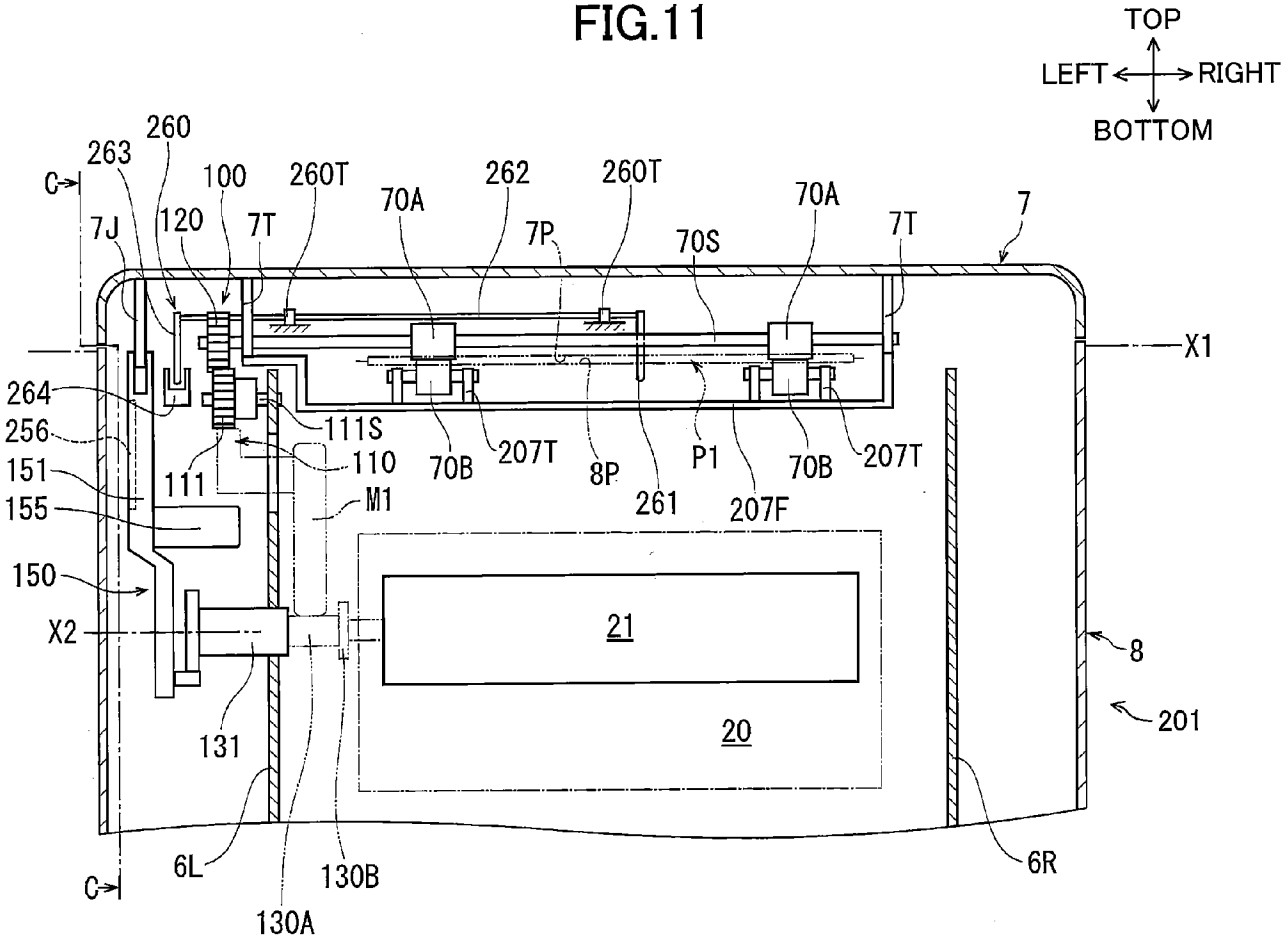
FIG. 11 is a partial schematic cross-sectional view of the image forming apparatus according to a second embodiment of the present invention, similar to the view shown in FIG. 3, in which a cover of the image forming apparatus is at a closed position.

As shown in FIG. 11, in the image forming apparatus 201, the roller support portion 8T of the image forming apparatus 1 is not provided. Instead, a frame 207F is connected to the pair of roller support portions 7T provided at the cover 7.

More specifically, when the cover 7 is at the closed position, the frame 207F is positioned below the conveying passage P1 and extends in the rightward/leftward direction. The frame 207F has a left end portion connected to a lower end portion of the left roller support portion 7T, and has a right end portion connected to the right roller support portion 7T.

Figure 12:
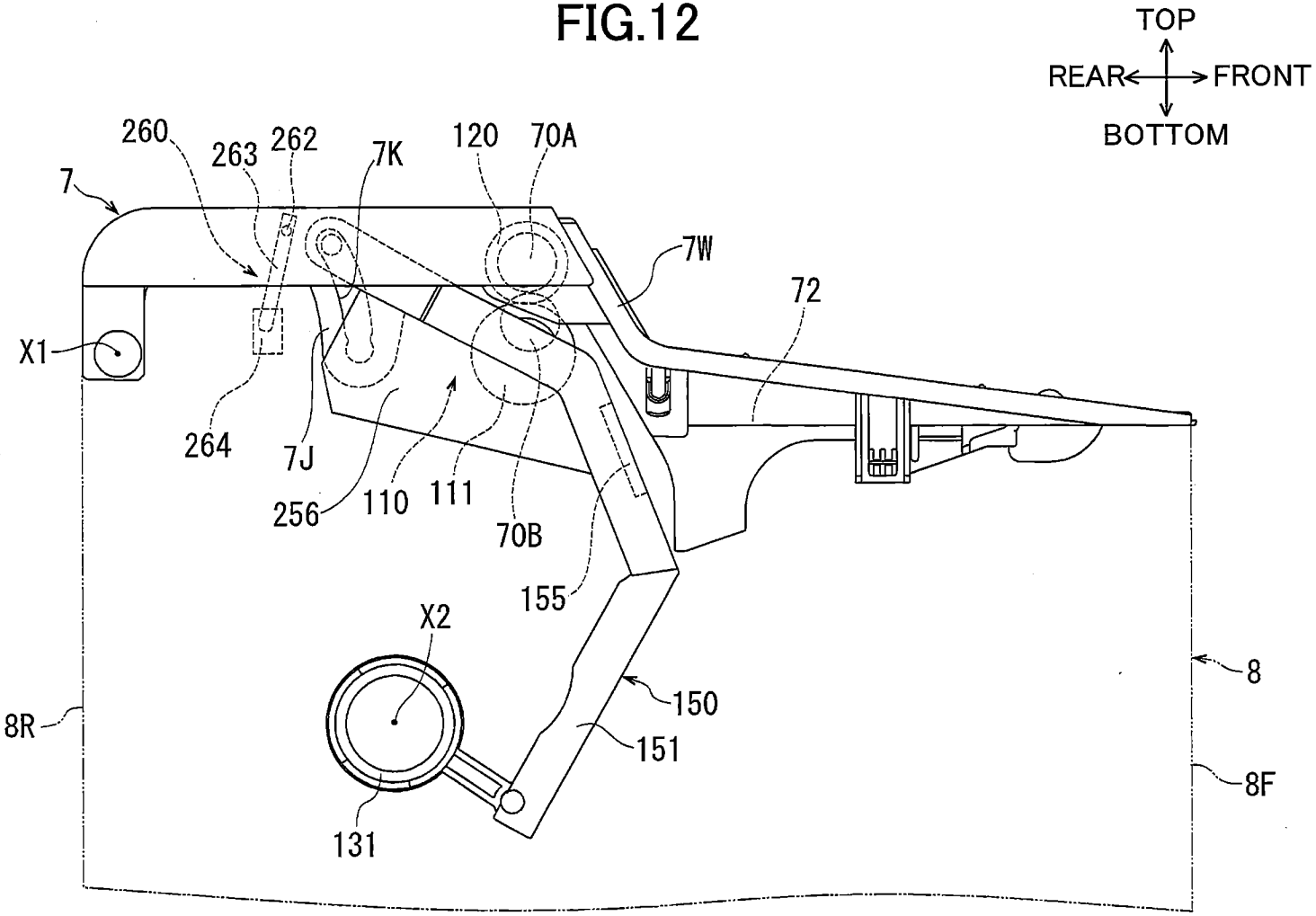
FIG. 12 is a partial schematic cross-sectional view of an image forming apparatus according to the second embodiment taken along a line C-C shown in FIG. 11, in which the cover is at the closed position.

The frame 207F has a pair of roller support portions 207T on an upper surface thereof. In the first embodiment, the discharge driven roller 70B is rotatably supported to the roller support portion 8T as shown in FIG. 3, however, in the second embodiment, the discharge driven roller 70B is rotatably supported to the roller support portion 207T as shown in FIG. 11. As described in the first embodiment, in the second embodiment as well, the discharge driven roller 70B is positioned below the conveying passage P1 (at the lower guide surface 8P side in FIG. 11), and in confrontation with the discharge drive roller 70A, interposing the conveying passage P1 between the discharge drive roller 70A and the discharge driven roller 70B. Further, the discharge driven roller 70B is driven by the discharge drive roller 70A and rotated in association with rotation of the discharge drive roller 70A. In FIG. 12, the discharge drive roller 70A and the discharge driven roller 70B in the state where the cover 7 is at the closed position are illustrated by broken lines.

Figure 13:
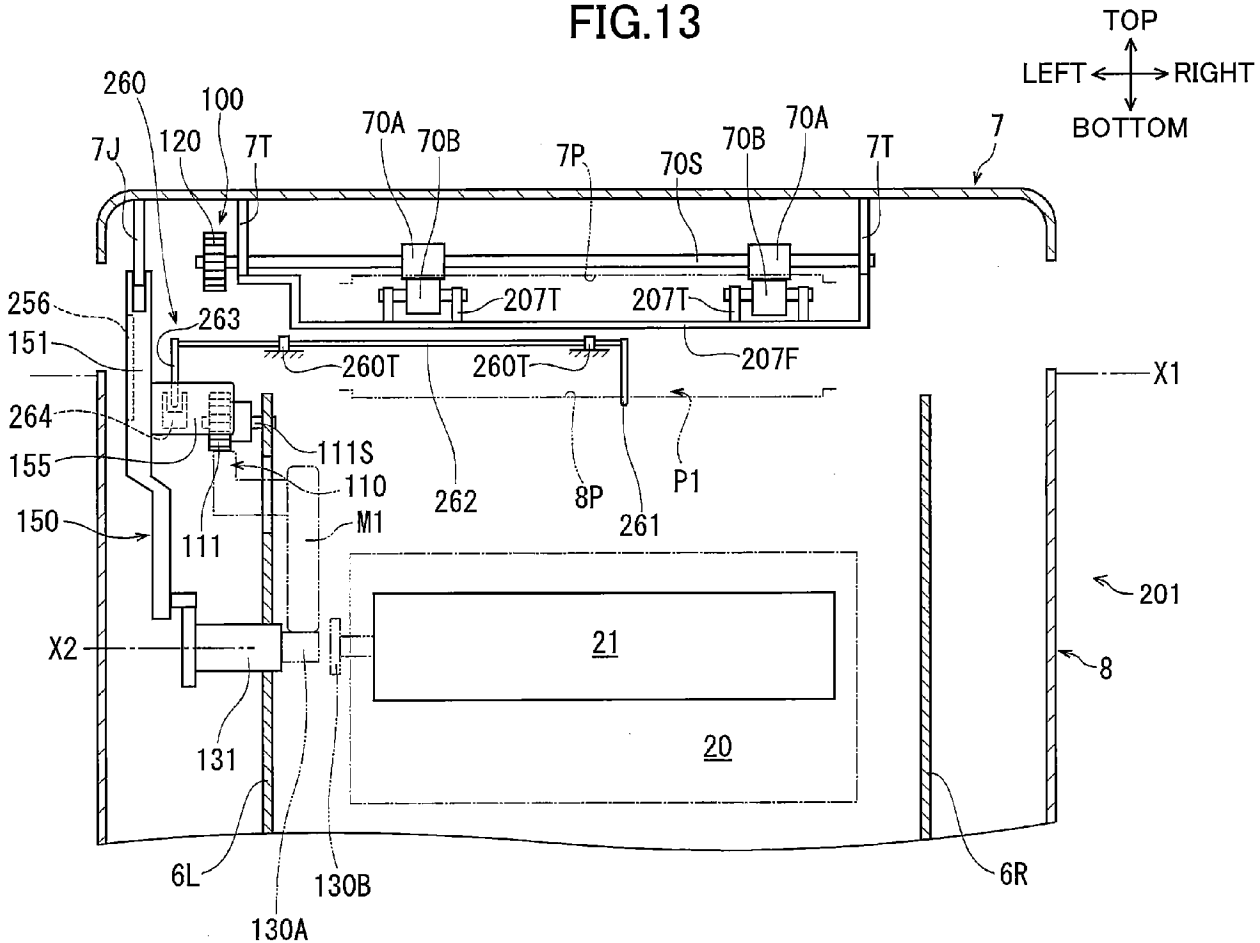
FIG. 13 is a partial schematic cross-sectional view of the image forming apparatus according to the second embodiment, similar to the view shown in FIG. 11, in which the cover of the image forming apparatus is at an open position.
Figure 14:
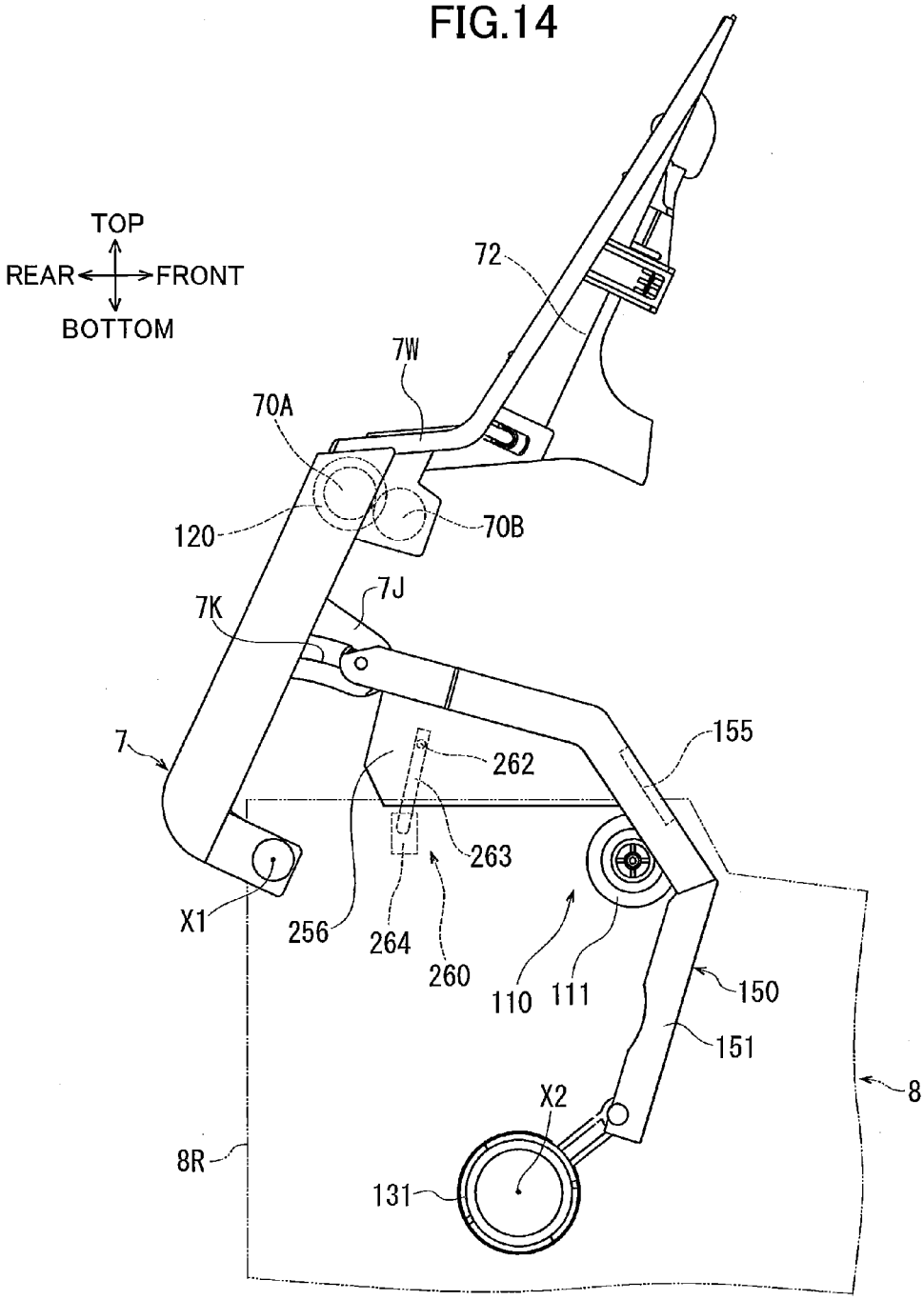
FIG. 14 is a partial schematic cross-sectional view of the image forming apparatus according to the second embodiment, similar to the view shown in FIG. 12, in which the cover is at the open position.

As shown in FIG. 13, when the cover 7 is at the open position, the discharge drive roller 70A and the discharge driven roller 70B, integrally with the cover 7 and the upper guide surface 7P, are spaced away from and upward from the lower guide surface 8P positioned at the main body 8 side. When the cover 7 is at the open position, the connecting portion 111 of the main body side transmission portion 110 and the cover side transmission portion 120 are spaced away from each other in the vertical direction, thereby interrupting the drive force from the drive source M1 to the discharge drive roller 70A. Accordingly, the discharge drive roller 70A is independently rotatable relative to the drive source M1. In FIG. 14, the discharge drive roller 70A and the discharge driven roller 70B in the state where the cover 7 is at the open position are illustrated by broken lines.

While described with reference to FIGS. 3 through 10 in the first embodiment, the interlocking assembly 150 is movable in interlocking relation to the opening and closing movement of the cover 7. As shown in FIGS. 13 and 14, when the cover 7 is at the open position, the cover portion 155 is positioned to cover the connecting portion 111.

As shown in FIGS. 11 through 16, within the main body 8, the actuator 260 is provided. The actuator 260 includes a contact portion 261, a transmission portion 262, a movable portion 263, and a detection portion 264.

Figure 15:
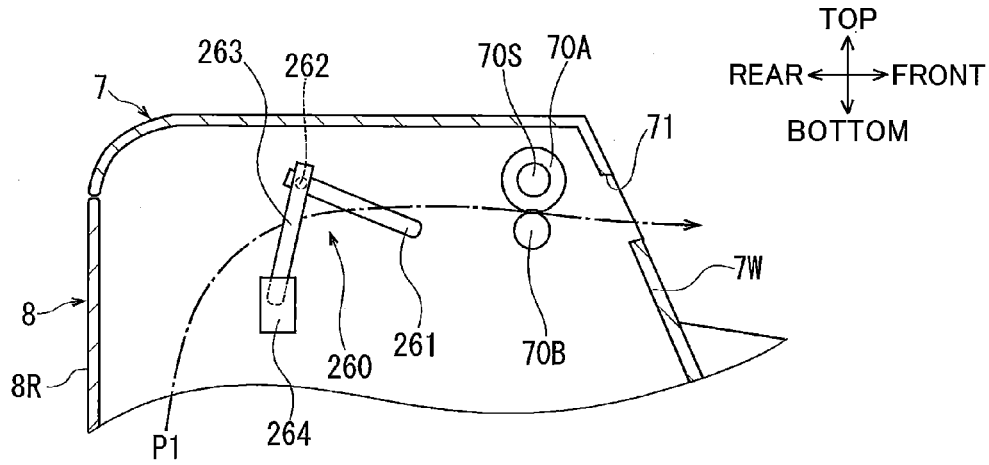
FIG. 15 is a partial schematic cross-sectional view for illustrating a movement of an actuator provided in the image forming apparatus according to the second embodiment.

As shown in FIGS. 11 and 15, the contact portion 261 is disposed at the center portion of the main body 8 and also disposed between the inner side frames 6R, 6L. That is, the contact portion 261 is disposed inward of the inner side frames 6R, 6L in the widthwise direction. Further, the contact portion 261 is disposed, within the main body 8, rearward of the discharge drive roller 70A and the discharge driven roller 70B. The contact portion 261 is formed in a bar shape, extending diagonally frontward and downward from a position above the conveying passage P1.

Figure 16:
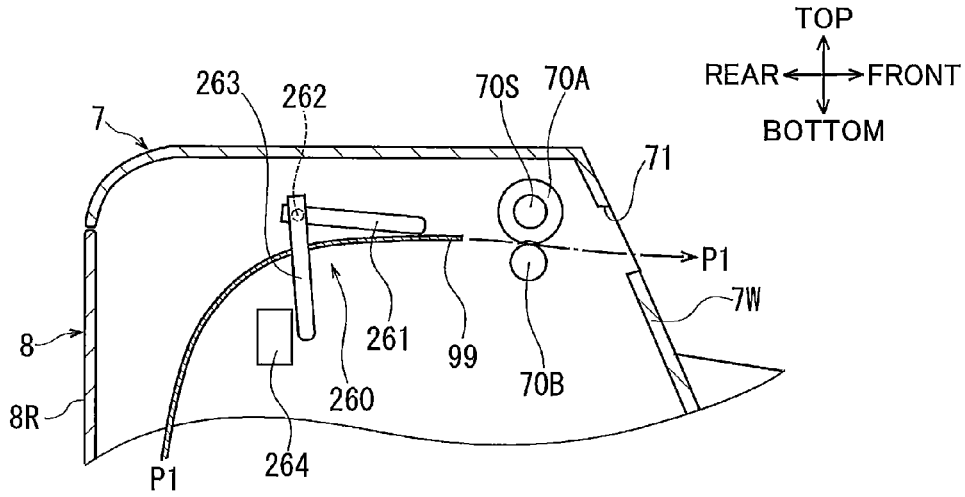
FIG. 16 is a partial schematic cross-sectional view for illustrating a movement of the actuator provided in the image forming apparatus according to the second embodiment.

As shown in FIG. 15, when the sheet 99 does not exist in the conveying passage P1 at a position adjacent to the discharge drive roller 70A and the discharge driven roller 70B, a lower end portion of the contact portion 261 is positioned downward of the conveying passage P1. That is, the contact portion 261 intersects the conveying passage P1. On the other hand, as shown in FIG. 16, when the sheet 99 exists in the conveying passage P1 at a position adjacent to the discharge drive roller 70A and the discharge driven roller 70B, the lower end portion of the contact portion 261 is contacted with the sheet 99. Hence, the lower end portion of the contact portion 261 is pressed upward.

As shown in FIGS. 11 through 13, the transmission portion 262 is a shaft extending in the rightward/leftward direction. The transmission portion 262 has a right end portion connected to an upper end portion of the contact portion 261. The transmission portion 262 extends from the contact portion 261 leftward of each of the left inner side frame 6L, the main body side transmission portion 110, and the cover side transmission portion 120. That is, the transmission portion 262 extends from the contact portion 261 outward of each of the left inner side frame 6L, the main body side transmission portion 110, and the cover side transmission portion 120 in the widthwise direction. Further, the transmission portion 262 is rotatably supported to a pair of actuator support portions 260T provided at the inner frame (not shown) of the main body 8.

The movable portion 263 is connected to a left end portion of the transmission portion 262. The movable portion 263 is formed in a bar shape extending downward from the transmission portion 262, that is, extending in a direction perpendicular to the widthwise direction. The movable portion 263 is positioned rightward of the link arm portion 151. When the contact portion 261 is moved to a position shown in each of FIG. 15 and FIG. 16, the movement of the contact portion 261 is transmitted to the movable portion 263 through the transmission portion 262. Thus, the movable portion 263 is movable between a position shown in FIG. 15 and a position shown in FIG. 16 in association with the movement of the contact portion 261.

The detection portion 264 is disposed in proximity to a lower end portion of the movable portion 263. The detection portion 264 is a proximity sensor such as a photo-interrupter. When the movable portion 263 is adjacent to the detection portion 264 as shown in FIG. 15, the detection portion 264 outputs a signal to the control unit (not shown). When the movable portion 263 is away from the detection portion 264 as shown in FIG. 16, the detection portion 264 outputs to the control unit (not shown) a signal different from the signal outputted when the movable portion 263 is adjacent to the detection portion 264. With this configuration, the control unit (not shown) can detect the existence of the sheet 99 conveyed by the discharge drive roller 70A and the discharge driven roller 70B in the conveying passage P1.

As shown in FIGS. 11 and 12, the actuator cover 256 is integral with the link arm portion 151 and disposed above the cover portion 155 of the interlocking assembly 150. The actuator cover 256 is formed in a flat plate shape and extends downward from the link arm portion 151. That is, the actuator cover 256 extends in the direction perpendicular to the widthwise direction. As shown in FIG. 11, the actuator cover 256 is positioned leftward of the movable portion 263.

As shown in FIG. 12, when the cover 7 is at the closed position, the actuator cover 256 is positioned frontward of the movable portion 263 of the actuator 260. When the cover 7 is moved to the open position and the link arm portion 151 is moved in association with the opening movement of the cover 7, the actuator cover 256 is moved upward and rearward from a position shown in FIG. 12. Then, as shown in FIG. 14, when the cover 7 is at the open position, the actuator cover 256 is provided at a position covering the movable portion 263 from a left side thereof, that is, from an outer side of the movable portion 263 in the widthwise direction. In other words, when the cover 7 is at the open position, the actuator cover 256 covers the movable portion 263 and is positioned outward of the movable portion 263 in the widthwise direction.

<Advantageous Effects>

In the image forming apparatus 201 according to the above-described second embodiment, as shown in FIG. 11, not only the discharge drive roller 70A but also the discharge driven roller 70B is rotatably supported to the cover 7. With this configuration, when the cover 7 is moved to the open position while the sheet 99 has been jammed in the conveying passage P1 at a position adjacent to the discharge drive roller 70A and the discharge driven roller 70B, the discharge drive roller 70A and the discharge driven roller 70B are moved integrally with the cover 7, and thus, moved spaced away and upward from the main body 8, as shown in FIGS. 13 and 14. In this state, as shown in FIG. 13, the cover side transmission portion 120 and the main body side transmission portion 110 are spaced away from each other, thereby interrupting transmission of the drive force from the drive source M1 to the discharge drive roller 70A. Therefore, the discharge drive roller 70A is independently rotatable relative to the drive source M1. With this configuration, when the jammed sheet 99 is removed, the discharge drive roller 70A nipping the sheet 99 with the discharge driven roller 70B is unlikely to be an obstacle to removal of the jammed sheet 99. Hence, the jammed sheet 99 can be easily removed.

Further, in the image forming apparatus 201 according to the above-described second embodiment, similar to the image forming apparatus 1 according to the first embodiment described above while referring to FIG. 10, when the cover 7 is at the open position, assuming that the cover portion 155 is not provided at the interlocking assembly 150, the connecting portion 111 is exposed to an outside of the main body 8. However, in the image forming apparatus 201 according to the above-described second embodiment, as shown in FIG. 13, the connecting portion 111 is covered with the cover portion 155. Hence, interference of external foreign materials with the connecting portion 111 can be avoided.

Accordingly, in the image forming apparatus 201 according to the above-described second embodiment, when the sheet 99 is jammed in the conveying passage P1 at a position adjacent to the discharge drive roller 70A and the discharge driven roller 70B, the jammed sheet 99 can be easily removed, and, in addition, improvement of durability of the drive force transmission unit 100 can be realized.

Further, in the image forming apparatus 201 according to the above-described second embodiment, as shown in FIGS. 13 and 14, when the cover 7 is at the open position, the actuator cover 256 covers the movable portion 263 of the actuator 260 from a left side thereof, that is, from an outer side thereof in the widthwise direction. Hence, interference of external foreign materials with the movable portion 263 can be avoided. Therefore, in the image forming apparatus 201 according to the second embodiment, degradation of durability of the actuator 260 can be restrained.

<Modifications>

While the present invention has been described in detail with reference to the embodiments thereof, it would be apparent to those skilled in the art that various changes and modifications may be made therein without departing from the spirit of the present invention.

According to the above-described first and second embodiments, the connecting portion 111 is a spur gear. However, the connecting portion 111 may be a coupling.

According to the above-described first and second embodiments, the interlocking assembly 150 is adapted to cover the connecting portion 111 in interlocking relation to the opening movement of the cover 7. However, for example, the interlocking assembly 150 may be adapted to release a nip state between the heating roller 31 and the pressure roller 32 of the fixing unit 30 in interlocking relation to the opening movement of the cover 7. Alternatively, the interlocking assembly 150 may be adapted to cover the scanner unit 29 with a shutter in interlocking relation to the opening movement of the cover 7 so as to prevent an exposure light emitted from the scanner unit 29 from entering eyes of the user when the cover 7 is open.

The present invention is applicable to, for example, an image forming apparatus, an image reading apparatus, a multi-function device, and the like.

What is claimed is:

1. A sheet conveying device comprising:

a main body defining a conveying passage along which a sheet is conveyed;

a cover supported to the main body and movable between a closed position in which the cover covers the main body and an open position in which the cover is spaced away from the main body;

a first roller rotatably supported to the cover and configured to discharge the sheet from the conveying passage to outside of the main body;

a second roller rotatably supported to one of the cover and the main body, and disposed in confrontation with the first roller while interposing the conveying passage between the first roller and the second roller when the cover is at the closed position, the second roller being configured to be driven by the first roller;

a drive source configured to generate a drive force;

a drive force transmission unit configured to transmit the drive force from the drive source to the first roller, the drive force transmission unit comprising:

a first transmission portion provided at the main body, and a second transmission portion provided at the cover, the first transmission portion and the second transmission portion being configured to be connected to each other to transmit the drive force from the drive source to the first roller through the first transmission portion and the second transmission portion when the cover is at the closed position, the first transmission portion and the second transmission portion also being configured to be spaced away from each other to interrupt transmission of the drive force from the drive source to the first roller when the cover is at the open position, the first transmission portion including a connecting portion configured to be connected to the second transmission portion when the cover is at the closed position and also configured to be spaced away from the second transmission portion and exposed to outside of the main body when the cover is at the open position; and an interlocking assembly disposed between the cover and the main body, and configured to be moved in interlocking relation to movement of the cover to a first position in response to movement to the open position, and to a second position in response to movement to the closed position, the interlocking assembly being positioned to cover the connecting portion when the interlocking assembly is at the first position.

2. The sheet conveying device as claimed in claim 1, wherein the interlocking assembly includes a link arm portion connecting the cover and the main body.

3. The sheet conveying device as claimed in claim 2, wherein the sheet is discharged from the conveying passage to the outside of the main body in a discharging direction, the sheet discharged from the conveying passage defining a widthwise direction perpendicular to the discharging direction of the sheet;

wherein the link arm portion is positioned so as to be offset from the connecting portion in the widthwise direction; and wherein the interlocking assembly further includes a cover portion protruding from the link arm portion in the widthwise direction, the cover portion being positioned to cover the connecting portion when the interlocking assembly is at the first position.

4. The sheet conveying device as claimed in claim 3, wherein the link arm portion is positioned outward of the connecting portion in the widthwise direction; and wherein the cover portion protrudes inward from the link arm portion in the widthwise direction.

5. The sheet conveying device as claimed in claim 2, wherein the sheet is discharged from the conveying passage to the outside of the main body in a discharging direction, the sheet discharged from the conveying passage defining a widthwise direction perpendicular to the discharging direction of the sheet; and wherein the sheet conveying device further comprises an actuator disposed in the main body and configured to detect existence of the sheet conveyed by the first roller and the second roller in the conveying passage, the actuator including:

a contact portion configured to be moved by contacting the sheet conveyed in the conveying passage;

a transmission portion extending outward from the contact portion in the widthwise direction;

a movable portion extending from the transmission portion in a direction perpendicular to the widthwise direction and configured to be moved in association with a movement of the contact portion; and a detection portion configured to detect a movement of the movable portion, wherein the interlocking assembly further includes an actuator cover extending from the link arm portion in the direction perpendicular to the widthwise direction, the actuator cover being configured to cover the movable portion and positioned outward of the movable portion in the widthwise direction when the interlocking assembly is at the first position.

6. The sheet conveying device as claimed in claim 1, wherein the interlocking assembly is further configured to serve as a link mechanism to perform an operation in interlocking relation to movement of the cover in addition to an operation for covering the connecting portion.

7. The sheet conveying device as claimed in claim 6, further comprising:

an image forming unit provided in the main body and configured to form an image on the sheet while the sheet is conveyed in the conveying passage;

a first coupling configured to be connected to the drive source; and a second coupling configured to be coupled to the first coupling, wherein the first coupling is configured to transmit the drive force from the drive source to the image forming unit through the second coupling, wherein the interlocking assembly is further configured to move the first coupling away from the second coupling when the interlocking assembly is at the first position, and to provide connection between the first coupling and the second coupling when the interlocking assembly is at the second position.

8. The sheet conveying device as claimed in claim 6, wherein the interlocking assembly is further configured to maintain the cover at the open position when the interlocking assembly is at the first position.

9. The sheet conveying device as claimed in claim 1, wherein the sheet has a first surface and a second surface opposite to the first surface;

wherein the sheet conveying device further comprises an image forming unit provided in the main body and configured to form an image on the first surface while the sheet is conveyed in the conveying passage; and wherein the first roller is positioned opposite to the first surface with respect to the second surface.

10. The sheet conveying device as claimed in claim 9, wherein the sheet is discharged from the conveying passage to the outside of the main body in a discharging direction; and wherein the sheet conveying device further comprises a sheet feeding unit provided in the main body and disposed below the image forming unit, the sheet feeding unit being configured to feed the sheet to the conveying passage in a feeding direction opposite to the discharging direction, wherein the conveying passage has a curved configuration extending from the sheet feeding unit to the outside of the main body through the image forming unit, the first roller and the second roller so that an orientation of the conveying passage is changed from the feeding direction to the discharging direction.

11. A sheet conveying device comprising:

a main body defining a conveying passage along which a sheet is conveyed;

a cover supported to the main body and movable between a closed position in which the cover covers the main body from above and an open position in which the cover is moved upward from the main body so as to be spaced away from the main body;

a first roller rotatably supported to the cover and configured to discharge the sheet from the conveying passage to outside of the main body;

a second roller rotatably supported to the main body and disposed in confrontation with the first roller while interposing the conveying passage between the first roller and the second roller when the cover is at the closed position;

a drive source configured to generate a drive force; and a drive force transmission unit configured to transmit the drive force from the drive source to the first roller, the second roller being configured to be driven by the first roller, the drive force transmission unit comprising:

a first transmission portion provided at the main body, and a second transmission portion provided at the cover, the first transmission portion and the second transmission portion being configured to be connected to each other to transmit the drive force from the drive source to the first roller through the first transmission portion and the second transmission portion when the cover is at the closed position, the first transmission portion and the second transmission portion also being configured to be spaced away from each other to interrupt transmission of the drive force from the drive source to the first roller when the cover is at the open position.

12. The sheet conveying device as claimed in claim 11, wherein the first transmission portion includes a connecting portion configured to be connected to the second transmission portion when the cover is at the closed position and also configured to be spaced away from the second transmission portion and exposed to outside of the main body when the cover is at the open position; and wherein the sheet conveying device further comprises an interlocking assembly disposed between the cover and the main body, and configured to be moved in interlocking relation to movement of the cover to a first position in response to movement to the open position, and to a second position in response to movement to the closed position, the interlocking assembly being positioned to cover the connecting portion when the interlocking assembly is at the first position.

13. The sheet conveying device as claimed in claim 12, wherein the interlocking assembly includes a link arm portion connecting the cover and the main body.

14. The sheet conveying device as claimed in claim 13, wherein the sheet is discharged from the conveying passage to the outside of the main body in a discharging direction, the sheet discharged from the conveying passage defining a widthwise direction perpendicular to the discharging direction of the sheet;

wherein the link arm portion is positioned so as to be offset from the connecting portion in the widthwise direction; and wherein the interlocking assembly further includes a cover portion protruding from the link arm portion in the widthwise direction, the cover portion being positioned to cover the connecting portion when the interlocking assembly is at the first position.

15. The sheet conveying device as claimed in claim 14, wherein the link arm portion is positioned outward of the connecting portion in the widthwise direction; and wherein the cover portion protrudes inward from the link arm portion in the widthwise direction.

16. The sheet conveying device as claimed in claim 12, wherein the interlocking assembly is further configured to serve as a link mechanism to perform an operation in interlocking relation to movement of the cover in addition to an operation for covering the connecting portion.

17. The sheet conveying device as claimed in claim 16, further comprising:

an image forming unit provided in the main body and configured to form an image on the sheet while the sheet is conveyed in the conveying passage;

a first coupling configured to be connected to the drive source; and a second coupling configured to be coupled to the first coupling, wherein the first coupling is configured to transmit the drive force from the drive source to the image forming unit through the second coupling, wherein the interlocking assembly is further configured to move the first coupling away from the second coupling when the interlocking assembly is at the first position, and to provide connection between the first coupling and the second coupling when the interlocking assembly is at the second position.

18. The sheet conveying device as claimed in claim 16, wherein the interlocking assembly is further configured to maintain the cover at the open position when the interlocking assembly is at the first position.

19. The sheet conveying device as claimed in claim 11, wherein the sheet has a first surface and a second surface opposite to the first surface;

wherein the sheet conveying device further comprises an image forming unit provided in the main body and configured to form an image on the first surface while the sheet is conveyed in the conveying passage; and wherein the first roller is positioned opposite to the first surface with respect to the second surface.

20. The sheet conveying device as claimed in claim 19, wherein the sheet is discharged from the conveying passage to the outside of the main body in a discharging direction;

wherein the sheet conveying device further comprises a sheet feeding unit provided in the main body and disposed below the image forming unit, the sheet feeding unit being configured to feed the sheet to the conveying passage in a feeding direction opposite to the discharging direction; and wherein the conveying passage has a curved configuration extending from the sheet feeding unit to the outside of the main body through the image forming unit, the first roller and the second roller so that an orientation of the conveying passage is changed from the feeding direction to the discharging direction.

* * * * *